US010923338B2

(12) United States Patent
Cooks et al.

(10) Patent No.: US 10,923,338 B2
(45) Date of Patent: Feb. 16, 2021

(54) ION FOCUSING

(71) Applicant: Purdue Research Foundation, West Lafayette, IN (US)

(72) Inventors: Robert Graham Cooks, West Lafayette, IN (US); Zane Baird, West Lafayette, IN (US); Wen-Ping Peng, Hualien (TW)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 16/987,594

(22) Filed: Aug. 7, 2020

(65) Prior Publication Data

US 2020/0381237 A1 Dec. 3, 2020

Related U.S. Application Data

(63) Continuation of application No. 16/803,023, filed on Feb. 27, 2020, now Pat. No. 10,777,400, which is a continuation of application No. 16/000,526, filed on Jun. 5, 2018, now Pat. No. 10,615,021, which is a continuation of application No. 15/407,499, filed on Jan. 17, 2017, now Pat. No. 10,014,169, which is a continuation of application No. 14/936,223, filed on Nov. 9, 2015, now Pat. No. 9,548,192, which is a continuation of application No. 14/391,867, filed as (Continued)

(51) Int. Cl.

| | |
|---|---|
| ***H01J 49/06*** | (2006.01) |
| ***H01J 49/10*** | (2006.01) |
| ***H01J 49/26*** | (2006.01) |
| ***H01J 49/16*** | (2006.01) |

(52) U.S. Cl.

CPC ..... *H01J 49/067* (2013.01); *H01J 49/06* (2013.01); *H01J 49/10* (2013.01); *H01J 49/165* (2013.01); *H01J 49/26* (2013.01)

(58) Field of Classification Search

CPC ..... H01J 49/165; H01J 49/06; H01J 49/067; H01J 49/10; H01J 49/26; H01J 49/04; H01J 49/049; H01J 49/107; H01J 49/142; G01N 30/724; G01N 30/7246; G01N 30/7266

USPC ..... 250/282, 288

See application file for complete search history.

(56) References Cited

U.S. PATENT DOCUMENTS

| | | | | |
|---|---|---|---|---|
| 7,847,244 | B2 * | 12/2010 | Venter | H01J 49/142 250/288 |
| 9,184,038 | B2 * | 11/2015 | Cooks | H01J 49/10 |
| 9,548,192 | B2 * | 1/2017 | Cooks | H01J 49/26 |

(Continued)

*Primary Examiner* — David A Vanore

(74) *Attorney, Agent, or Firm* — Brown Rudnick LLP; Adam M. Schoen

(57) ABSTRACT

The invention generally relates to apparatuses for focusing ions at or above ambient pressure and methods of use thereof. In certain embodiments, the invention provides an apparatus for focusing ions that includes an electrode having a cavity, at least one inlet within the electrode configured to operatively couple with an ionization source, such that discharge generated by the ionization source is injected into the cavity of the electrode, and an outlet. The cavity in the electrode is shaped such that upon application of voltage to the electrode, ions within the cavity are focused and directed to the outlet, which is positioned such that a proximal end of the outlet receives the focused ions and a distal end of the outlet is open to ambient pressure.

12 Claims, 20 Drawing Sheets

Related U.S. Application Data application No. PCT/US2013/041348 on May 16, 2013, now Pat. No. 9,184,038.

(60) Provisional application No. 61/656,261, filed on Jun. 6, 2012.

(56) References Cited

U.S. PATENT DOCUMENTS

| | | | | |
|---|---|---|---|---|
| 10,014,169 | B2 * | 7/2018 | Cooks | H01J 49/165 |
| 10,615,021 | B2 * | 4/2020 | Cooks | H01J 49/26 |
| 2003/0189170 | A1 * | 10/2003 | Covey | H01J 49/165<br>250/288 |
| 2004/0094706 | A1 * | 5/2004 | Covey | H01J 49/04<br>250/288 |

* cited by examiner

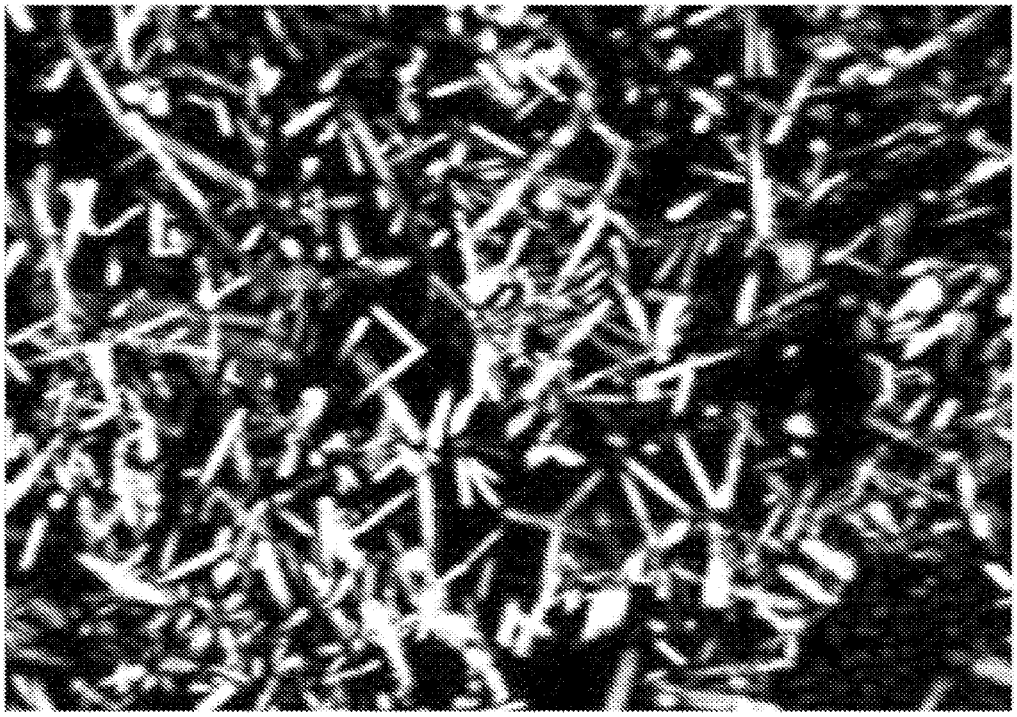
FIG. 20
FIG. 21
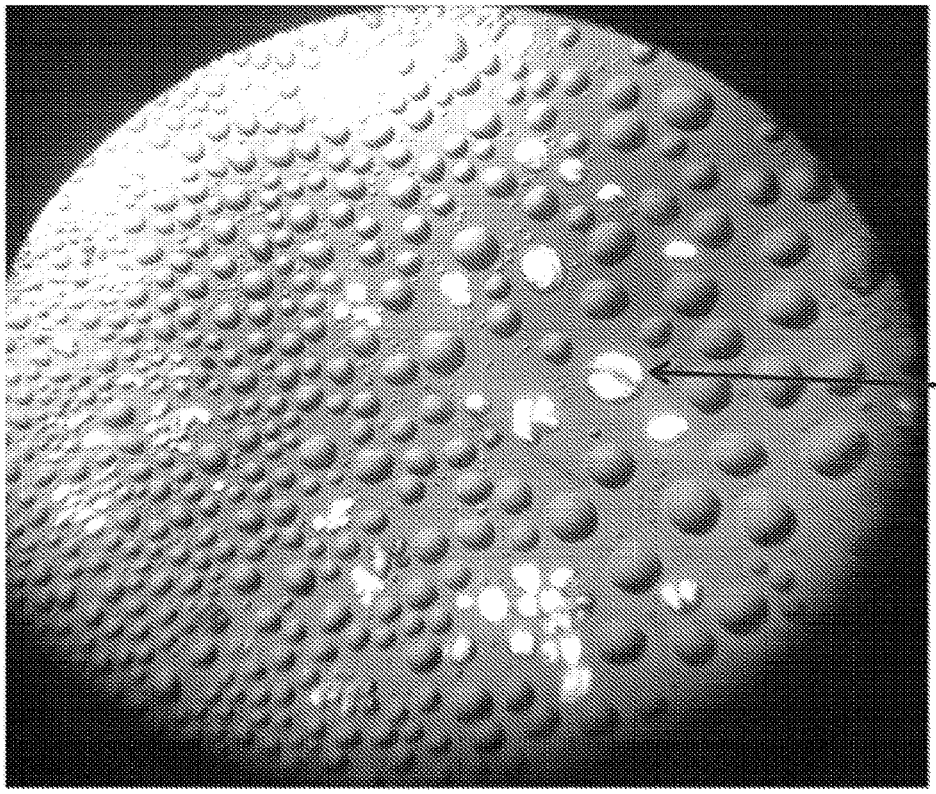
crystals growing in the droplets (microscope image)

ION FOCUSING

RELATED APPLICATIONS

The present application is a continuation of U.S. nonprovisional application Ser. No. 16/803,023, filed Feb. 27, 2020, which is a continuation of U.S. nonprovisional application Ser. No. 16/000,526, filed Jun. 5, 2018, which is a continuation of U.S. nonprovisional application Ser. No. 15/407,499, filed Jan. 17, 2017, which is a continuation of U.S. nonprovisional application Ser. No. 14/936,223, filed Nov. 9, 2015, which is a continuation of U.S. nonprovisional application Ser. No. 14/391,867, filed Oct. 10, 2014, which is a 35 U.S.C. § 371 national phase application of PCT/US13/41348, filed May 16, 2013, which claims the benefit of and priority to U.S. provisional application Ser. No. 61/656,261, filed Jun. 6, 2012, the content of each of which is incorporated by reference herein in its entirety.

GOVERNMENT INTEREST

This invention was made with government support under DE-FG02-06ER15807 awarded by the Department of Energy. The government has certain rights in the invention.

FIELD OF THE INVENTION

The invention generally relates to apparatuses for focusing ions at or above ambient pressure and methods of use thereof.

BACKGROUND

The prominent and rapidly expanding role of mass spectrometry (MS) in the physical and biological sciences can be attributed in part to the versatility afforded by the growing catalog of available ionization methods. Many ionization techniques of increasing importance operate at elevated or atmospheric pressure, including electrospray ionization (ESI), atmospheric pressure matrix-assisted laser desorption/ionization (AP-MALDI), and desorption electro-spray ionization (DESI). To achieve the maximum possible sensitivity, ions created at atmospheric or higher pressures must be transmitted into the mass spectrometer with high efficiency through a narrow, conductance limiting aperture.

Ion transfer from the ambient environment into a mass spectrometer is a problem associated with ambient ionization techniques. Generally, in ambient ionization, ions are generated at atmospheric pressure and subsequently transferred into a mass spectrometer that operates under vacuum, i.e., having separate differentially pumped vacuum chambers that ions pass through prior to reaching the high vacuum region of the mass analyzer. To maintain the vacuum, a mass spectrometer is coupled to continuously operating pumps, which consume a large amount of power. Accordingly, an inlet of a mass spectrometer is generally kept as small as possible to minimize vacuum pumping requirements on the mass spectrometer. Having a small inlet decreases ion transfer efficiency into the mass spectrometer, limiting system sensitivity by preventing a certain number of ions from ever entering the mass spectrometer. The ion transfer efficiency (as well as the total ion flux) can be increased by increasing the size of the inlet. However, increasing the inlet size makes it more difficult to maintain the mass spectrometer under vacuum, increasing the stress and power requirements on the pumps of the system.

SUMMARY

The invention generally provides apparatuses for focusing ions at or above ambient pressure and methods of use thereof. Unlike traditional ion optics that are ineffective at ambient pressures and operate exclusively under vacuum, apparatuses of the invention are able to focus ions produced at ambient pressure prior to the ions being introduced into a mass spectrometer. The spatial control and focus of the ions in air allows for a smaller inlet into the mass spectrometer, thus reducing pumping requirements. Apparatuses of the invention are particularly useful with miniature mass spectrometers where pumping speed is restricted due to power requirements. Apparatuses of the invention allow for continuous ion introduction into a miniature mass spectrometer, improving the duty cycle of the miniature mass spectrometer.

In certain aspects, the invention provides an apparatus for focusing ions that includes an electrode having a cavity, at least one inlet within the electrode configured to operatively couple with an ionization source, such that discharge generated by the source (e.g., charged microdroplets) is injected into the cavity of the electrode, and an outlet. The cavity in the electrode is shaped such that upon application of voltage to the electrode, ions within the cavity are focused and directed to the outlet, which is positioned such that a proximal end of the outlet receives the focused ions and a distal end of the outlet is open to ambient pressure. The term ion includes charged microdroplets. Generally, the outlet is grounded. Any ambient ionization source may be coupled to apparatuses of the invention. Exemplary source include electrospray and nano electrospray probes.

The electrode and the cavity can be any shape that allows for the focusing of ions. In certain embodiments, the cavity of the electrode has an ellipsoidal shape. In this embodiment, the electrode is arranged such that the narrowest portion of the ellipsoid is positioned farthest from the outlet and the widest portion of the ellipsoid is positioned closest to the outlet. In other embodiments, the cavity is a hollow half-ellipsoidal cavity, i.e., the cavity is open to the air. In other embodiments, the electrode is domed shaped and connected to the outlet such that the cavity seals to the outlet. In this manner, the cavity may be pressurized. In other embodiments, the outlet is not connected to the electrode, rather it is in close proximity to the opening of the elliptical cavity to produce electrical fields that facilitate the focusing of the ions in the cavity generated by the ion generation device.

Apparatuses of the invention may further include a gas inlet in order to produce a turbulent flow within the cavity. The gas flow both enhances the desolvation of charged microdroplets to produce ions for analysis and can assist in focusing the ions with appropriate flow fields. Apparatuses of the invention may further include a plurality of ring electrodes positioned within an interior portion of the cavity such that they are aligned with the outlet, wherein the electrodes are arranged in order of decreasing inner diameter with respect to the outlet.

In other aspects, the invention provides a system for analyzing a sample that includes an ionization source, an ion focusing apparatus, in which the focusing apparatus is configured to receive charged microdroplets from the ionization source, focus the ions (including charged microdroplets) at or above ambient pressure, and expel the ions (including charged microdroplets) at ambient pressure, and a mass analyzer positioned to receive the focused ions expelled from the ion focusing apparatus. In certain embodiments, the ion focusing apparatus includes an electrode having a cavity, at least one inlet within the electrode configured to operatively couple with an ionization source, such that discharge generated by the source (e.g., charged microdroplets) is injected into the cavity of the electrode, and an outlet, in which the cavity in the electrode is shaped such that upon application of voltage to the electrode, ions (including charged desolvated microdroplets) within the cavity are focused and directed to the outlet, which is positioned such that a proximal end of the outlet receives the focused ions and a distal end of the outlet is open to ambient pressure.

The ionization source may be any ambient ionization source, such as electrospray and nano electrospray probes. Generally, the mass analyzer is for a mass spectrometer (including an ion mobility mass spectrometer) or a handheld mass spectrometer. Exemplary mass analyzers include a quadrupole ion trap, a rectalinear ion trap, a cylindrical ion trap, a ion cyclotron resonance trap, an orbitrap, a time of flight, a Fourier Transform ion cyclotron resonance, and sectors.

Another aspect of the invention provides a method for analyzing a sample that involves obtaining a sample, generating ions of an analyte from the sample, focusing the ions, directing the focused ions into an inlet of a mass spectrometer, and analyzing the ions. In certain embodiments, focusing includes injecting charged microdroplets into a cavity of an electrode, the cavity being shaped to focus ions, applying a voltage to the electrode, thereby focusing the ions, directing the ions to an outlet positioned with respect to the cavity to receive the focused ions. In certain embodiments, the focusing step is performed at ambient pressure. In other embodiments, the focusing step is performed above ambient pressure. In certain embodiments, the mass spectrometer is a bench-top mass spectrometer or a miniature mass spectrometer. In certain embodiments, the focused ions are continuously directed into the miniature mass spectrometer.

Another aspect of the invention provides a method for collecting ions of an analyte of a sample that involves obtaining a sample, generating ions of an analyte from the sample, focusing the ions at or above ambient pressure, and collecting the focused ions.

BRIEF DESCRIPTION OF THE DRAWINGS

FIG. 1 is a cross-sectional cut-away view.

FIG. 3 is a cross-sectional cut-away view.

FIG. 4A shows a cut-away view of an apparatus used for nanoESI transport without on-axis copper electrodes. FIG. 4B shows a cut-away view of an apparatus used for nanoESI with on-axis copper electrodes. FIG. 4C shows a cut-away view of an apparatus used for nanoESI with a simple cylindrical copper electrode.

FIG. 7A is for 6 kV, FIG. 7B is for 6.5 kV, and FIG. 7C is for 7 kV. Ellipse potential was 5 kV in all cases. Ions were given a filled sphere initial distribution with radius of 1 cm, centered 0.5 cm below the axis of the ellipse, directly below the spray tip (25 mm from opening plane of ellipse). (0,0) coordinate corresponds to the center of ellipse opening plane.

FIG. 8A is a graph showing sprayer potential held 1 kV higher than ellipse potential throughout scan. FIG. 8B is a graph showing chromatograms of ion intensities using the ellipse electrode (solid lines) and without the ellipse electrode (dashed lines). Potentials of 3 and 4 kV were applied to the ellipse and sprayer, respectively. For nanoESI without the elliptical electrode, spray potential was 1 kV. In panel A, the sprayer was 27 mm distant from the inlet of the LTQ. Tip to inlet distance for FIG. 8B was 22 mm. Electrode arrangement corresponds to that shown in FIG. 4A.

FIG. 20 shows crystals of naproxen landed on a surface using focusing apparatuses of the invention.

FIG. 21 shows serine charged droplets deposited on a surface using focusing devices of the invention. The figure shows serine crystals growing in the droplets.

DETAILED DESCRIPTION

Figure 1:
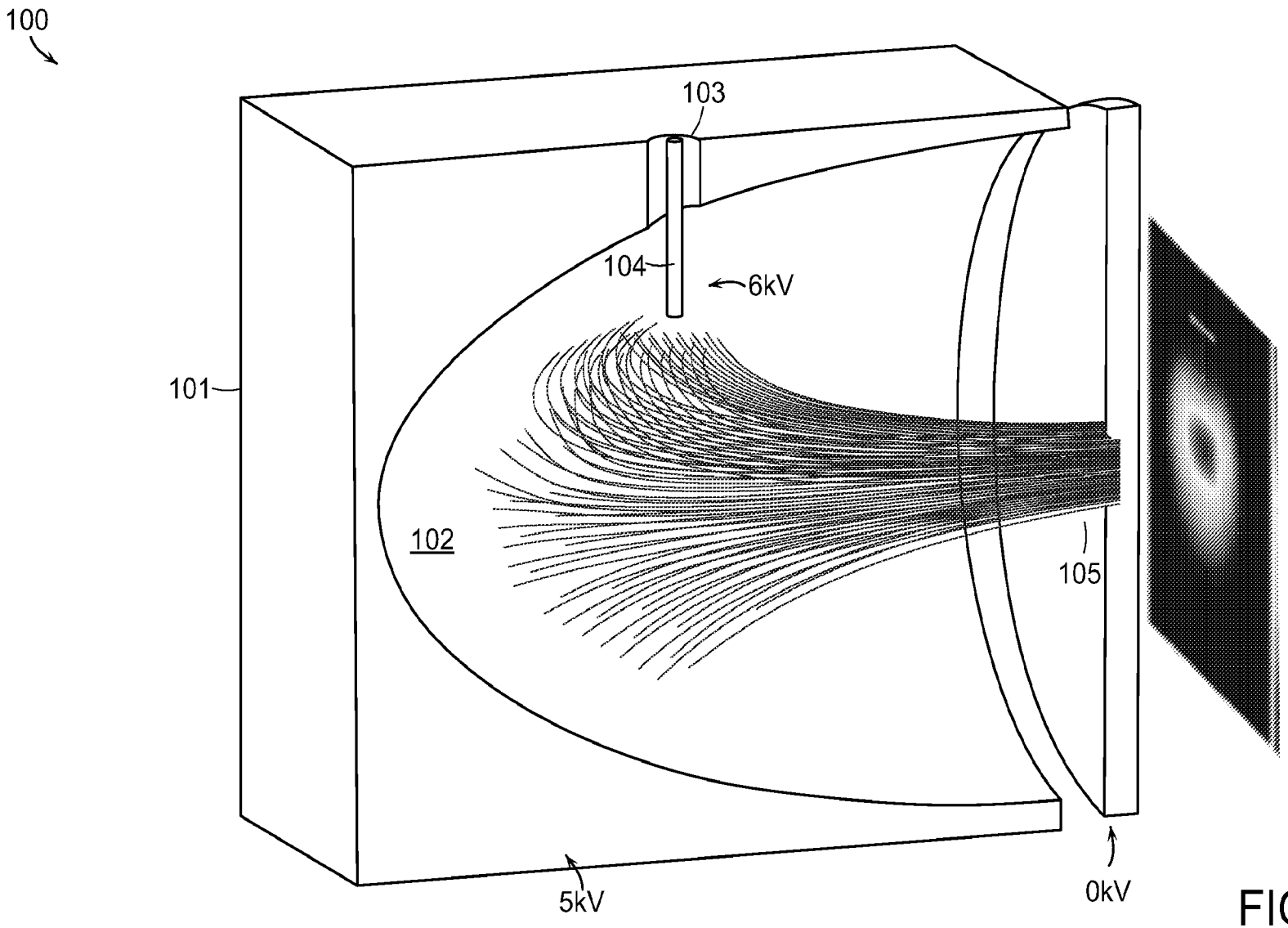
FIG. 1 is a schematic showing an exemplary embodiment of apparatuses of the invention.

The invention generally provides apparatuses for focusing ions at or above ambient pressure and methods of use thereof. FIG. 1 is a schematic showing an exemplary embodiment of an apparatus 100 of the invention. The apparatus 100 includes an electrode 101 having a cavity 102. Electrode 101 can be composed of any conductive material to which static electrical potentials can be applied. Exemplary materials include metals, such as aluminum/aluminum alloy, brass, silver, titanium, platinum, palladium, and copper. Other exemplary materials include ceramic, graphite, and other carbons. The electrode can also be a mixed metal oxide, which is an electrode have an oxide coating over an inert metal or carbon core. The oxides generally include precious metal (Ru, Ir, Pt) oxides for catalyzing an electrolysis reaction.

The electrode includes at least one inlet 103. The inlet 103 is configured to couple with an ionization source such that discharge generated by the source (e.g., charged microdroplets) is injected into the cavity 102 of the electrode 101. Generally, the inlet will have a diameter from about 1 mm to about 10 mm, preferably from about 1 mm to about 2 mm. Other inlet diameters may be used and the invention is not limited to the exemplified inlet diameters. In this figure, the inlet 103 is shown as being on a top side of the electrode 101. Such a position for the inlet is only exemplary, and the inlet 103 may be positioned anywhere about electrode 101. The only requirement is that the inlet 103 couples with the ionization source such that discharge (e.g., charged microdroplets) generated by the source is injected into the cavity 102. Additionally, FIG. 1 shows an embodiment that includes only a single inlet. This is only exemplary, and apparatuses of the invention can have more than one inlet, for example 2 inlets, 3 inlets, 4 inlets, 5 inlets, 10 inlets, 20 inlets, 30, inlets, 40 inlets, 50 inlets, 100 inlets, etc. The inlets can be positioned at any locations about the electrode 101.

The source may be any ambient ionization source known in the art. Exemplary mass spectrometry techniques that utilize direct ambient ionization/sampling methods including desorption electrospray ionization (DESI; Takats et al., Science, 306:471-473, 2004 and U.S. Pat. No. 7,335,897); direct analysis in real time (DART; Cody et al., Anal. Chem., 77:2297-2302, 2005); Atmospheric Pressure Dielectric Barrier Discharge Ionization (DBDI; Kogelschatz, Plasma Chemistry and Plasma Processing, 23:1-46, 2003, and PCT international publication number WO 2009/102766), and electrospray-assisted laser desoption/ionization (ELDI; Shiea et al., J. Rapid Communications in Mass Spectrometry, 19:3701-3704, 2005). The content of each of these references in incorporated by reference herein its entirety. In other embodiments, the probe operates by electrospray ionization (Fenn et al., Science 246 (4926): 64-71, 1989; and Ho et al., Clin Biochem Rev 24 (1): 3-12, 2003) or nanoelectrospray ionization (Karas et al., Journal of Analytical Chemistry, 366(6-7):669-676, 2000). The content of each of these references in incorporated by reference herein its entirety. In other embodiments, the probe is a paper spray probe (international patent application number PCT/US10/32881). In other embodiments, the probe is a low temperature plasma probe. Such probes are described in U.S. patent application Ser. No. 12/863,801, the content of which is incorporated by reference herein in its entirety.

Exemplary sources include an electrospray probe or a nanoelectrospray probe. In certain embodiments, the inlet 103 is configured to receive an electrospray capillary such that the spray (charged microdroplets) produced by the capillary is directly injected into the cavity 102 of the electrode 101. This is illustrated in FIG. 1 in which an electrospray capillary 104 is inserted within inlet 103. In other embodiments, the inlet 103 is configured to couple with a long distance transfer line such that spray produced a distance from the electrode 101 can still be directed into the electrode 101 for focusing of ions. Long distance transfer of charged microdroplets and/or ions and devices for accomplishing such long distance transfer are shown for example in PCT/US09/59514 to Purdue Research Foundation, the content of which is incorporated by reference herein in its entirety.

Apparatuses of the invention also include an outlet 105. The outlet 105 is configured such that a proximal end of the outlet 105 receives ions that have been focused in the cavity 102 and a distal end of the outlet 105 is open to ambient pressure. The outlet may include a short capillary tube that spans the outlet and assists in directing the focused beam of ions out of the apparatus 100. Generally, the outlet 105 will be grounded, as illustrated in FIG. 1 in which the outlet 105 has 0 volts while the electrode 101 has 5 volts and the ionization source 104 within inlet 103 has 6 volts. Generally, the outlet 105 is spaced apart from the electrode 101. Generally, the distance between the outlet 105 and the electrode 101 will be from about a couple of millimeters to several centimeters. The exact distance is not critical, so long as the outlet 105 is within a proximity of the electrode 101 such that the proximal end of the outlet 105 can receive the focused ions. In other embodiments, the outlet 105 is physically connected to the electrode 101, as described in other embodiments herein. Additionally, the positioning of the outlet 105 relative to the inlet 103 is exemplary, and apparatuses of the invention are not limited to the configuration shown in FIG. 1. The only requirement for location of the outlet 105 is that it be positioned such that a proximal end of the outlet 105 receives ions that have been focused in the cavity 102.

The cavity 102 in the electrode is shaped such that upon application of voltage to the electrode 101, ions within the cavity 102 are focused and directed to the outlet 105, which, as explained above, is positioned such that a proximal end of the outlet 105 receives the focused ions and a distal end of the outlet 105 is open to ambient pressure. In the exemplary embodiment of FIG. 1, the cavity has an ellipsoidal shape. Particularly, the electrode 101 is a hollow half-ellipsoidal cavity.

Figure 2:
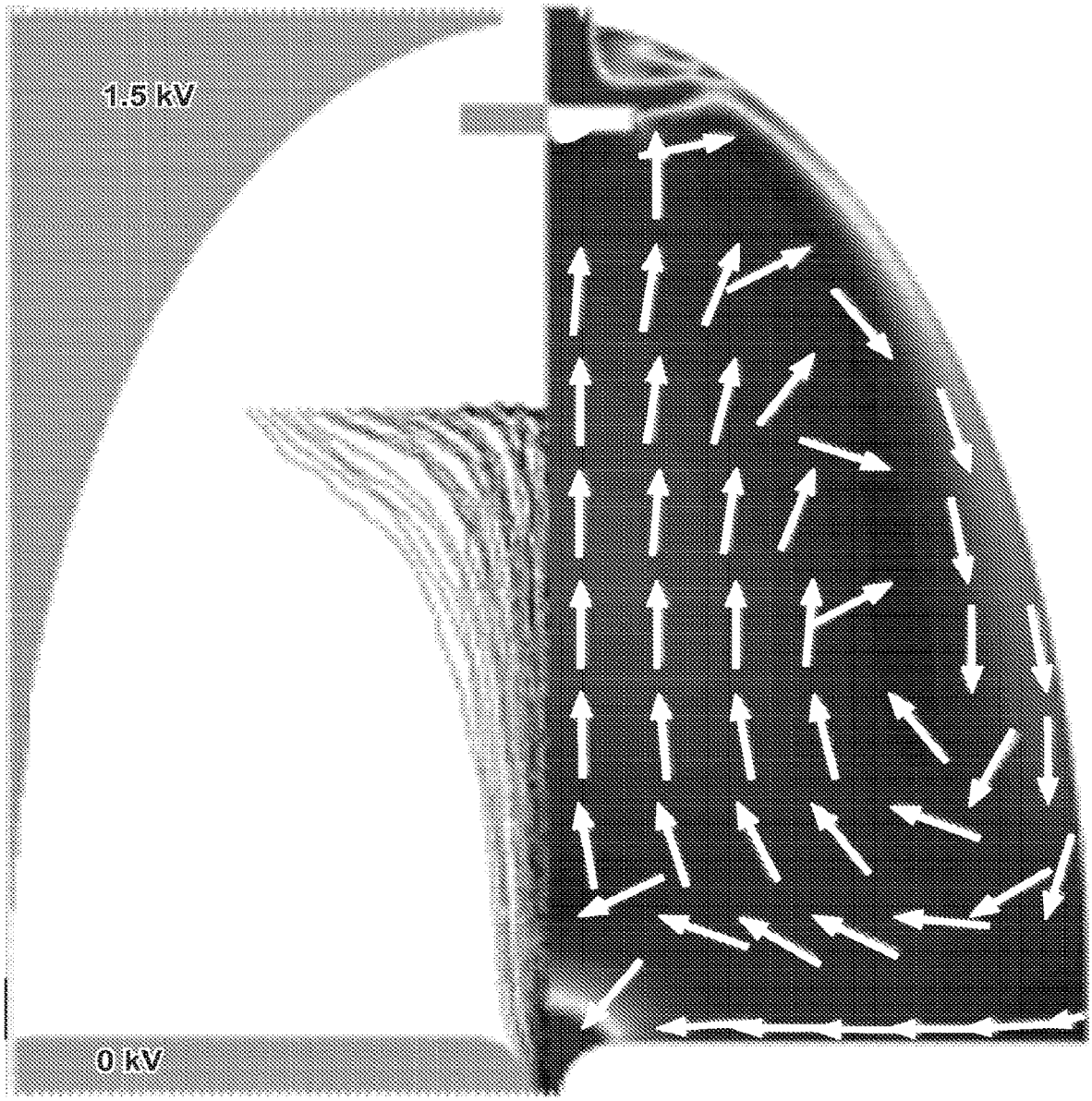
FIG. 2 is a schematic showing modeling of ion trajectories in apparatuses of the invention. Ion motion (black traces) within the proposed high-flux ion source due to a combination of fluid flow (right side of figure) and electrical effects.

FIG. 1 further includes a modeling of ion trajectories achieved using apparatuses of the invention. FIG. 2 also shows modeling of ion trajectories. FIG. 1 shows that upon injection of discharge (e.g., charged microdroplets) from the ionization source 104 through inlet 103 into cavity 102 of electrode 101, the discharge (e.g., charged microdroplets) demonstrate a spray plume, i.e., the discharge (e.g., droplets) are unfocused. Application of voltage to the electrode causes the plume of droplets to become focused and flow to outlet 105. The fluid flow and ion motion within the apparatus was calculated using Simion. In this manner, ions have been focused at atmospheric pressure and the focused ion beam that exits the outlet 105 can be directed into a mass spectrometer or used for other purposes, such as soft landing of ions for further ion/surface reactions or analyses.

In certain embodiments, apparatuses of the invention include a gas inlet. The gas inlets can be in communication with the atmosphere, such that ambient air can enter the cavity 102 through the gas inlet and exit through the outlet 105 along with the focused ions. Alternatively, the gas inlet can be in communication with a source of gas, such that gas is actively pumped into the cavity 102 and out the outlet 105. Having a gas inlet allows for the production of a turbulent air flow within the cavity 102. Without be limited by any particular theory or mechanism of action, it is believed that the gas flow both enhances the desolvation of the charged microdroplets to produce the ions within the cavity and assists in focusing the ions within the cavity with appropriate flow fields.

Figure 10:
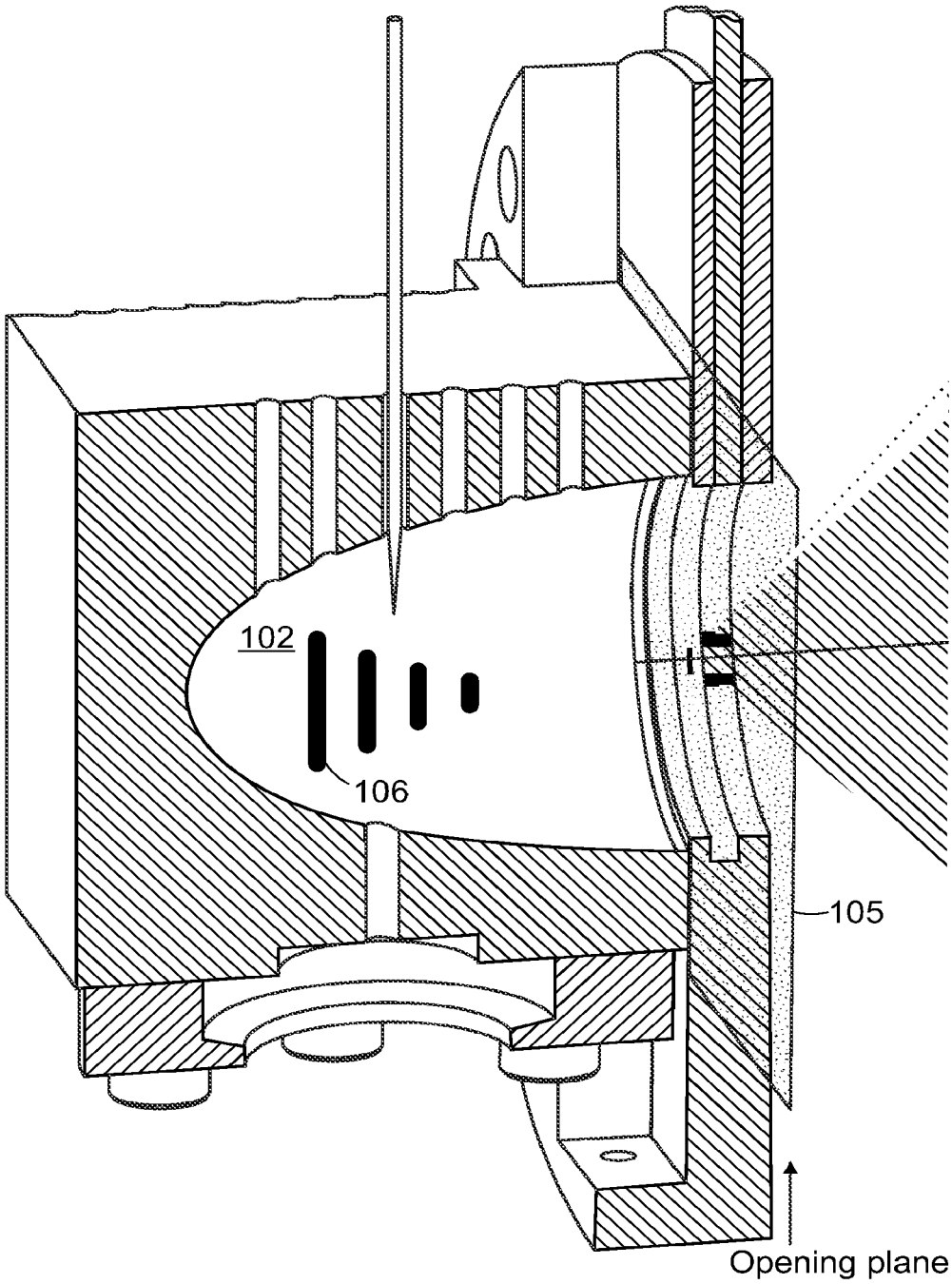
FIG. 10 is an embodiment showing an apparatus of the invention that further include a plurality of ring electrodes positioned within an interior portion of the cavity such that they are aligned with the outlet.

In other embodiments, as illustrated in FIG. 10, apparatuses of the invention can further include a plurality of ring electrodes 106 positioned within an interior portion of the cavity 102 such that they are aligned with the outlet 105. The ring electrodes are arranged in order of decreasing inner diameter with respect to the outlet 105. Such a configuration is essentially an ion funnel, that can act to assist in focusing of the ions within the cavity 102. Ion funnels are further described for example in Kelly et al. (Mass Spectrometry Reviews, 29:294-312, 2010), the content of which is incorporated by reference herein in its entirety.

Figure 3:
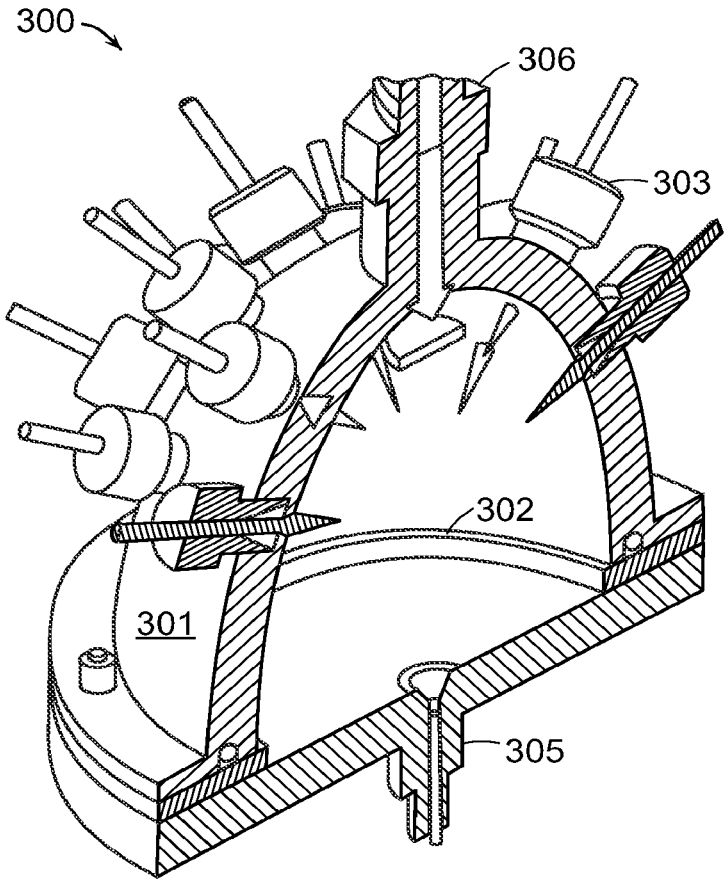
FIG. 3 is a schematic showing another exemplary embodiment of an apparatus of the invention.

FIG. 3 is a schematic showing another exemplary embodiment of an apparatus 300 of the invention. Similar to the embodiment shown in FIG. 1, the apparatus 300 includes an electrode 301 having a cavity 302. Electrode 301 can be composed of any conductive material to which static electrical potentials can be applied. In this embodiment, the electrode includes a plurality of inlets 303, arranged about the electrode 301. Each inlet 303 is configured to couple with an ionization source such that discharge generated by the source (e.g., charged microdroplets) is injected into the cavity 302 of the electrode 301.

Apparatus 300 also includes an outlet 305. The outlet 305 is configured such that a proximal end of the outlet 305 receives ions that have been focused in the cavity 302 and a distal end of the outlet 305 is open to ambient pressure. The outlet may include a short capillary tube that spans the outlet and assists in directing the focused beam of ions out of the apparatus 300. Generally, the outlet 305 will be grounded. In this embodiment, the outlet 305 is physically connected to the electrode 301. Such a configuration allows for pressurization of the cavity 302, as further explained below.

The cavity 302 in the electrode is shaped such that upon application of voltage to the electrode 301, ions within the cavity 302 are focused and directed to the outlet 305, which, as explained above, is positioned such that a proximal end of the outlet 105 receives the focused ions and a distal end of the outlet 105 is open to ambient pressure. In the exemplary embodiment of FIG. 3, the cavity has an ellipsoidal shape. Particularly, the electrode 301 is a hollow ellipsoidal cavity. It is important to note that FIG. 3 is a cross-sectional cut-away view. In this figure, the electrode 301 is a full dome that is physically coupled with the outlet 105 to form a sealed cavity 302. The sealed cavity 302, allows for pressurization of the cavity 302. In this manner, ions can be generated and focused above ambient pressure.

In certain embodiments, apparatuses of the invention include a gas inlet 306. In this embodiment, the gas inlet 306 is in communication with a source of gas, such that gas is actively pumped into the cavity 302 and out the outlet 305. In other embodiments, apparatuses of the invention can further include a plurality of ring electrodes, as illustrated in FIG. 10, positioned within an interior portion of the cavity 302 such that they are aligned with the outlet 305. The ring electrodes are arranged in order of decreasing inner diameter with respect to the outlet 305. Such a configuration is essentially an ion funnel, that can act to assist in focusing of the ions within the cavity 302.

While not being limited by any particular theory or mechanism of action, an explanation of ion focusing is provided. For a given geometry, the potential can be expressed as:

$$V(x,y,z) \text{ or } V(r,\theta,z).$$

Due to a cylindrical symmetry ($V_\theta$=const. for all the arbitrary x,z), the potential can be reduced to a 2-dimensional coordinate system V(x,z). To determine whether ions are concentrated or not, two conditions must be matched.

$$E_z(x) = \frac{\partial V}{\partial z} = 0 \text{ for all } x \tag{i}$$

$$\begin{cases} \dfrac{\partial^2 V}{\partial z^2} > 0 & \text{then ions are focusing} \quad (1) \\ \dfrac{\partial^2 V}{\partial z^2} = 0 & \text{then ions run into the focusing limit} \quad (2) \\ \dfrac{\partial^2 V}{\partial z^2} < 0 & \text{then ions are defocusing} \quad (3) \end{cases} \tag{ii}$$

Figure 11:
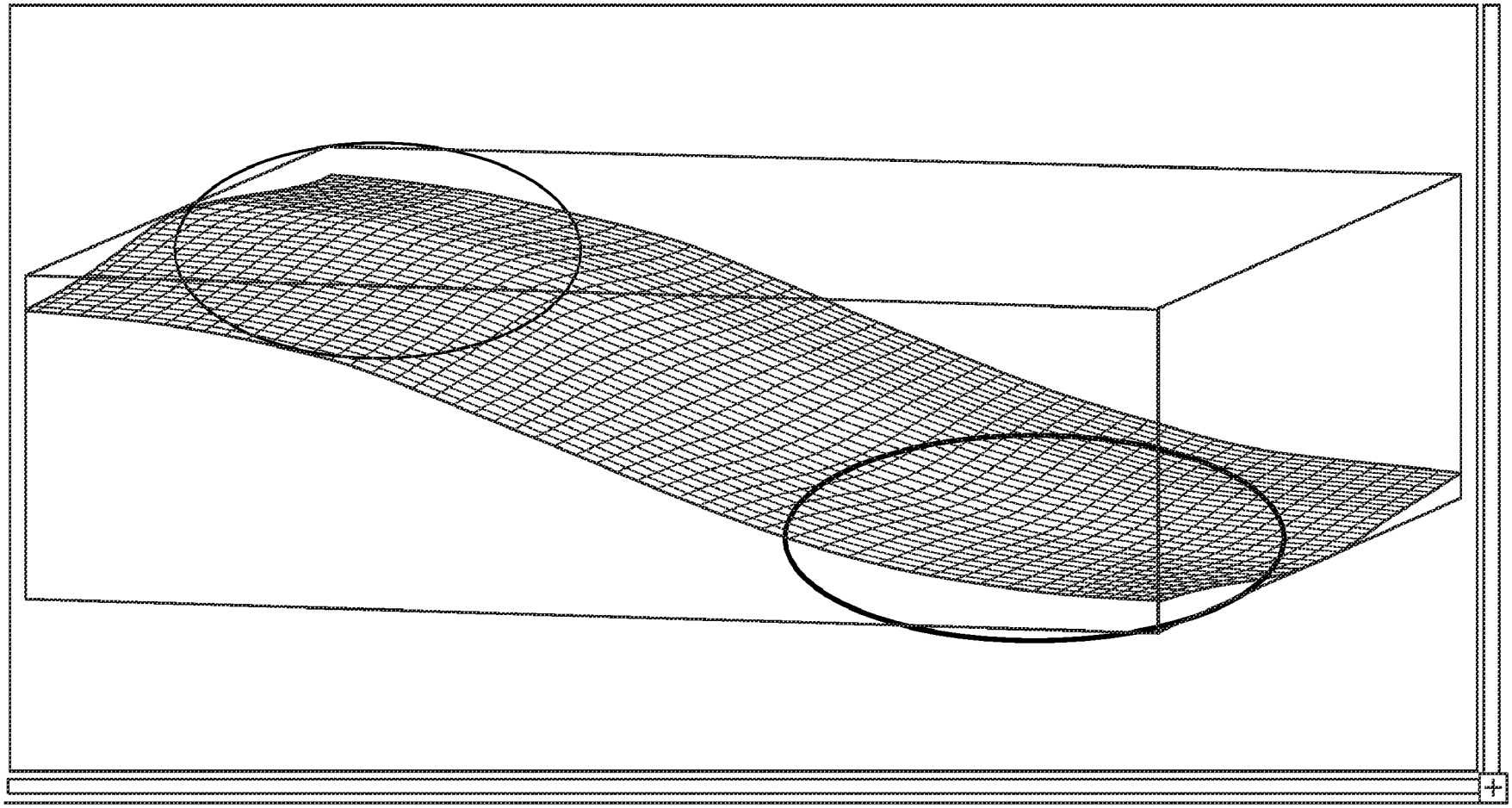
FIG. 11 is the potential view of an elliptical geometry.

These three cases can be easily determined by the potential graph as shown in FIG. 11. FIG. 11 is the potential view of an elliptical geometry, the circle on the left indicates case (3), the circle on the right indicates case (1), and case (2) must be a point between the two circles. For that analysis, it is believed that all cavity-like geometries are able to focus ions to a certain area.

Apparatuses of the invention can be operatively coupled with a mass analyzer such that the focused ions can be analyzed. Any mass analyzer known in the art can be operatively coupled with apparatuses of the invention. Generally, the mass analyzer is for a mass spectrometer (such as a bench-top mass spectrometer) or a handheld mass spectrometer. Exemplary mass analyzers include a quadrupole ion trap, a rectalinear ion trap, a cylindrical ion trap, a ion cyclotron resonance trap, an orbitrap, a time of flight, a Fourier Transform ion cyclotron resonance, and sectors. in particular embodiments, the mass spectrometer is a Thermo LTQ ion trap mass spectrometer, commercially available from Thermo Scientific (San Jose, Calif.).

In particular embodiments, apparatuses of the invention are coupled with a miniature mass spectrometer. An exemplary miniature mass spectrometer is a handheld rectilinear ion trap mass spectrometer, which is described, for example in Gao et al. (Anal. Chem., 80:7198-7205, 2008), Hou et al. (Anal. Chem., 83:1857-1861, 2011), and Sokol et al. (Int. J.

Mass Spectrom., In Press, Corrected Proof, 2011), the content of each of which is incorporated herein by reference herein in its entirety.

Apparatuses of the invention are particularly useful with miniature mass spectrometers where pumping speed is restricted due to power requirements. Apparatuses of the invention show more than 70% efficiency in directing ions into a 1 $cm^2$ area, an improvement of a factor of 4 when compared to nanoESI operated over the same distance but without the focusing electrode. Using apparatuses of the invention, the Mass spectrometer inlet can be reduced in size, thus reducing pumping requirements. In this manner, apparatuses of the invention allow for continuous ion introduction into a miniature mass spectrometer without overwhelming the vacuum pumps, improving the duty cycle of the miniature mass spectrometer.

Apparatuses of the invention are also useful for producing and focusing ions in air that can be collected (soft landed) on surfaces for use as reagents for chemical reactions occurring at surfaces. Systems and methods for collecting ions are shown in Cooks, (U.S. Pat. No. 7,361,311), the content of which is incorporated by reference herein in its entirety. In particular embodiments, apparatuses of the invention are coupled with nanoESI probes because nanoESI probes use a low flow rate such that molecular ions of low internal energy are produced, thus avoiding fragmentation. The challenge of using nanoESI is the large volume dispersion of ions in the spray plume. Apparatuses of the invention solve this problem, being able to focus of ions created by nanoESI. Using apparatuses of the invention, the increase in source to collector surface distance, compared to conventional methods, allows for more effective solvent evaporation, yielding solvent-free ions for use in ion/surface reactions. Additionally, using of apparatuses of the invention with multiplexed nanospray ESI sources provides a significant enhancement of total ion signal making nanoESI desirable as a means to create ions for use as reagents.

Apparatuses of the invention allow for the capture of intact polyatomic ions at a condensed phase interface—and reactive ion/surface collisions. The surfaces can subsequently be analyzed. Surface characterization methods include keV energy ion sputtering (SIMS), temperature programmed desorption (TPD), and surface enhanced Raman spectroscopy (SERS). Apparatuses of the invention can be used to investigate any chemical system. Exemplary chemical systems that can be investigated using apparatuses of the invention include olefin epoxidation, transacylation, aza-Diels-Alder reactions and nitrogen fixation into alkanes.

Another use for the invention is for altering chemical functionalities at a surface. Ions and charged droplets impinging on a surface have been shown to increase the efficiency and rate of chemical reactions occurring at the surface (Abraham et al., Journal of the American Society of Mass Spectrometry, 2012, 23, 1077-1084; Abraham et al., Journal of the American Society of Mass Spectrometry, 2012, 23, 842-849; and Abraham et al., Angewandte Chemie International Edition, 2012, 51, 1-6). This, when coupled with ion focusing with apparatuses and methods of the invention at or above atmospheric pressure, allows for embodiments in which ions are used to alter the chemical functionalities at a surface in a spatially resolved manner, all performed at atmospheric pressure. One example of such a case is the site-specific silylation of a glass surface via reactions of silylation agents (in charged droplets, or as free ions) with hydroxyl groups present on the glass to create hydrophobic areas. When combined with ambient ion focusing, spatially controlled chemically specific surface modification can be achieved at atmospheric pressure. This capability is not limited to silylation chemistry, which serves simply as one example of the chemistry possible.

Ion Transfer

Systems and methods of transferring ions are described, for example in Ouyang et al. (U.S. Pat. No. 8,410,431), the content of which is incorporated by reference herein in its entirety. Such devices generate a laminar gas flow that allows for efficient transfer of ions without significant loss of signal intensity over longer distances, such as distances of at least about 5 cm, at least about 10 cm, at least about 20 cm, at least about 50 cm, at least about 100 cm, at least about 500 cm, at least about 1 m, at least about 3 m, at least about 5 m, at least about 10 m, and other distances. Ion transfer devices of the invention are useful for chemical analysis in situations in which it is important for the ion focusing device or instrument and the object being examined to be in different locations. Generally, the ion transfer member is operably coupled to a gas flow generating device, in which the gas flow generating device produces a laminar gas flow that transfers the gas phase ions to an inlet of the ion focusing device.

Ion transfer devices of the invention provide enlarged flow to carry ions from a distant sample to the ion focusing device. The basic principle used in the transport device is the use of the gas flow to direct gas and ions into the ion transfer member and to form a laminar flow inside the ion transfer member to keep the ions away from the walls while transferring the gas and ions through the ion transfer member. The analyte ions of interest are sampled at some point downstream along the ion transfer member. The laminar flow is achieved by balancing the incoming and outgoing gas flow. Thus recirculation regions and/or turbulence are avoided. Thus, the generated laminar flow allows for high efficient ion transport over long distance or for sampling of ions over large areas.

Ion transfer devices of the invention also provide enlarged flow to carry ions from the ion source to the ion focusing device. Additional gas flow provided by a miniature sample pump connected with the ion transfer member facilitates ion transfer from an ambient ionization source to the vicinity of the ion focusing device.

Figure 18:
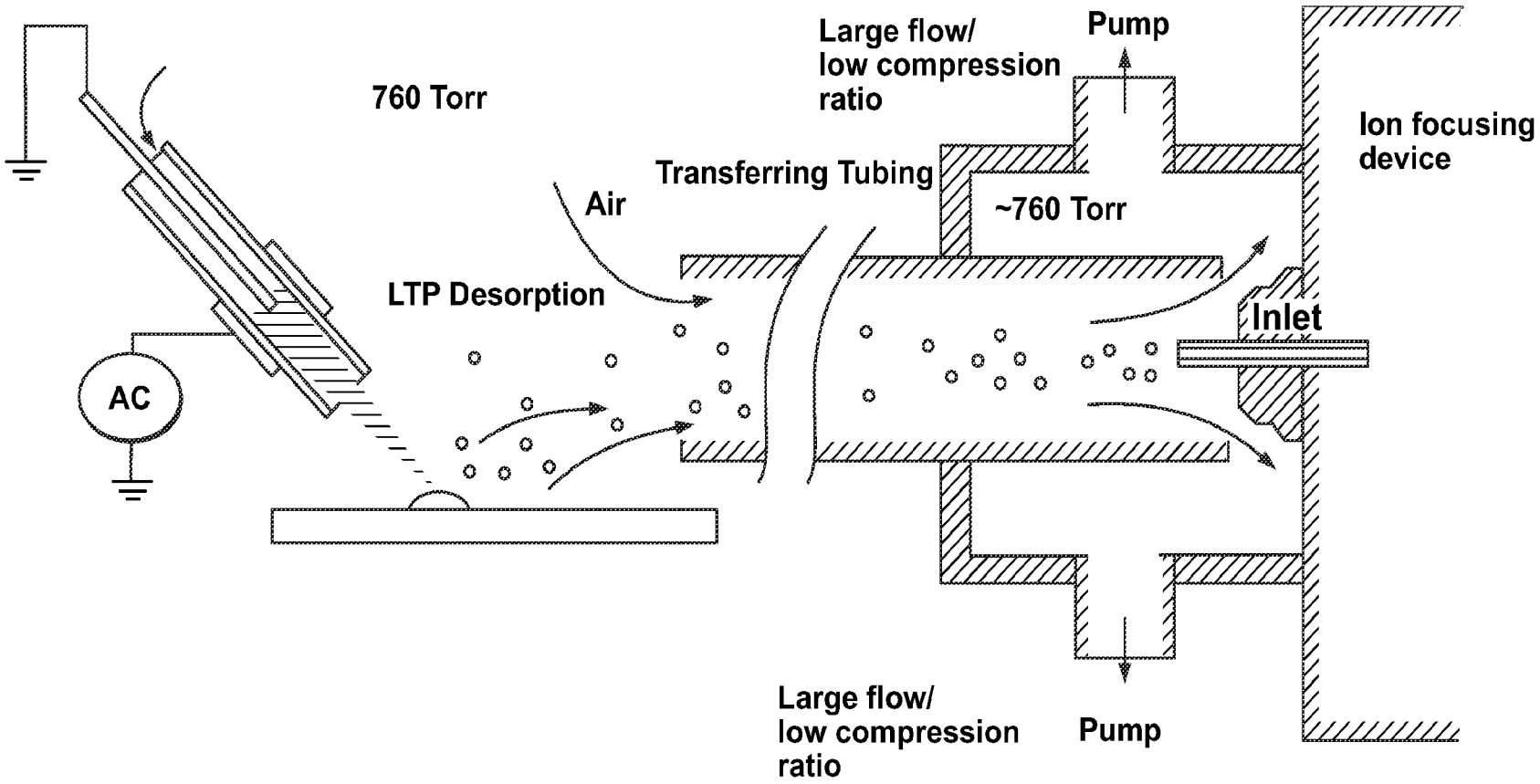
FIG. 18 is a schematic showing an embodiment of a system for transferring ions from an ambient ionization source to an inlet of an ion focusing device.

As shown in FIG. 18, an ion transfer member, e.g., a tube with an inner diameter of about 10 mm or greater, is used to transfer ions from the ionization source to the ion focusing device. The larger opening of the ion transfer member, as compared to the opening of the inlet of the ion focusing device, is helpful for collection of sample ions generated in a large space, e.g. on a surface of large area. The large flow conductance of the ion transfer member allows the gas carrying ions to move toward the inlet of the ion analysis device at a fast flow rate. The ion transfer member is coupled to a gas flow generating device. The gas flow generating device produces a gas flow inside the ion transfer member. The inlet of the ion analysis device receives the ions transferred from the ambient ionization source.

The ion transfer member may be any connector that allows for production of a laminar flow within it and facilitates transfer of ions without significant loss of ion current. Exemplary ion transfer members include tubes, capillaries, covered channels, open channels, and others. In a particular embodiment, the ion transfer member is a tube. The ion transfer member may be composed of rigid material, such as metal or glass, or may be composed of flexible material such as plastics, rubbers, or polymers. An exemplary flexible material is TYGON tubing.

The ion transfer member may be any shape as long the shape allows for the production of a flow to prevent the ions from reaching the internal surfaces of the ion transfer member where they might become neutral. For example, the ion transfer member may have the shape of a straight line. Alternatively, the ion transfer member may be curved or have multiple curves.

The ion transfer member is coupled to a gas flow generating device. The gas flow generating device is such a device capable of generating a gas flow through the ion transfer member. The gas flow generating device facilitates transfer of the ions from the ambient ionization source to the inlet of the ion analysis device. In certain embodiments, the gas flow generating device is a pump with a high flow rate and a low compression ratio. An example of such a pump is that found in a shop vacuum or a small sample pump. The proper pumps used for the coupling are different from those used for a mass spectrometer, e.g. a rotary vane pump or a turbo molecular pump, which pumps have a high compression ratio. The high compression ratio pumps of a mass spectrometer cannot be connected to the atmosphere through an opening of the conductance described here. For example, Cotte-Rodriguez et al. (Chem. Commun., 2006, 2968-2970) describe a set-up in which the inlet of the mass spectrometer was elongated and gas flow generated by the pump inside a mass spectrometer was used to transfer ions over a distance up to 1 μm. The ions were transferred from the atmosphere to a region at about 1 torr. A significant loss in signal occurred for the transfer of the ions using the set-up described in Cotte-Rodriguez, and ions generated over a large area could not be efficiently collected into the inlet.

In other embodiments, the gas flow generating device is the ambient ionization source. For example, a source used for desorption electrospray ionization (DESI) generates a gas flow sufficient to produce a laminar flow through the ion transfer member, and thus produces a laminar gas flow that transfers the gas phase ions over a long distance to an inlet of the ion analysis device.

Numerous additional devices may be coupled with the ion transfer member to further facilitate transfer of the ions from the ambient ionization source to the inlet of the ion focusing device. For example, an electric lens may be used to focus the ions toward the center of the ion transfer member while the gas flow generating device pumps away neutral gases. In other embodiments, an electro-hydrodynamic lens system may be implemented to use the air dynamic effects to focus the heavier particles and to use the electric field to focus the charged particles toward the center of the ion transfer member.

In other embodiments, a distal end of the ion transfer member may include a plurality of inlets for transferring ions from multiple locations to the inlet of the ion focusing device. In still other embodiments, the ion transfer member includes additional features to prevent ions from being adsorbed onto the inside wall. For example, a dielectric barrier discharge (DBD) tubing is made from a double stranded speaker wire. The insulator of the wire serves as the dielectric barrier and the DBD occurs when high voltage AC is applied between the two strands of the wire. The DBD inside the tube prevents the ions from adsorbing onto the wall and provide a charge-enriched environment to keep the ions in the gas phase. This DBD tube can also be used for ionizing the gas samples while transferring the ions generated to the inlet of the ion focusing device. The DBD tube can also be used for ion reactions while transferring the ions generated to the inlet of the ion focusing device.

Collection of Ions

Systems and methods for collecting ions that have been analyzed by a mass spectrometer are shown in Cooks, (U.S. Pat. No. 7,361,311), the content of which is incorporated by reference herein in its entirety. Generally, the preparation of microchips arrays of molecules first involves the ionization of analyte molecules in the sample (solid or liquid). The molecules can be ionized by any of the methods discussed above. The ions can then be focused and collected using methods described below or can first be separated based on their mass/charge ratio or their mobility or both their mass/charge ratio and mobility. For example, the ions can be accumulated in an ion storage device such as a quadrupole ion trap (Paul trap, including the variants known as the cylindrical ion trap and the linear ion trap) or an ion cyclotron resonance (ICR) trap. Either within this device or using a separate mass analyzer (such as a quadrupole mass filter or magnetic sector or time of flight), the stored ions are separated based on mass/charge ratios. Additional separation might be based on mobility using ion drift devices or the two processes can be integrated. The separated ions are then deposited on a microchip or substrate at individual spots or locations in accordance with their mass/charge ratio or their mobility to form a microarray.

To achieve this, the microchip or substrate is moved or scanned in the x-y directions and stopped at each spot location for a predetermined time to permit the deposit of a sufficient number of molecules to form a spot having a predetermined density. Alternatively, the gas phase ions can be directed electronically or magnetically to different spots on the surface of a stationary chip or substrate. The molecules are preferably deposited on the surface with preservation of their structure, that is, they are soft-landed. Two facts make it likely that dissociation or denaturation on landing can be avoided. Suitable surfaces for soft-landing are chemically inert surfaces that can efficiently remove vibrational energy during landing, but which will allow spectroscopic identification. Surfaces which promote neutralization, rehydration or having other special characteristics might also be used for protein soft-landing.

Generally, the surface for ion landing is located after the ion focusing device, and in embodiments where ions are first separated, the surface is located behind the detector assembly of the mass spectrometer. In the ion detection mode, the high voltages on the conversion dynode and the multiplier are turned on and the ions are detected to allow the overall spectral qualities, signal-to-noise ratio and mass resolution over the full mass range to be examined. In the ion-landing mode, the voltages on the conversion dynode and the multiplier are turned off and the ions are allowed to pass through the hole in the detection assembly to reach the landing surface of the plate (such as a gold plate). The surface is grounded and the potential difference between the source and the surface is 0 volts.

An exemplary substrate for soft landing is a gold substrate (20 mm×50 mm, International Wafer Service). This substrate may consist of a Si wafer with 5 nm chromium adhesion layer and 200 nm of polycrystalline vapor deposited gold. Before it is used for ion landing, the substrate is cleaned with a mixture of $H_2SO_4$ and $H_2O_2$ in a ratio of 2:1, washed thoroughly with deionized water and absolute ethanol, and then dried at 150° C. A Teflon mask, 24 mm×71 mm with a hole of 8 mm diameter in the center, is used to cover the gold surface so that only a circular area with a diameter of 8 mm on the gold surface is exposed to the ion beam for ion soft-landing of each mass-selected ion beam. The Teflon mask is also cleaned with 1:1 MeOH:$H_2O$ (v/v) and dried at elevated temperature before use. The surface and the mask are fixed on a holder and the exposed surface area is aligned with the center of the ion optical axis.

Any period of time may be used for landing of the ions. Between each ion-landing, the instrument is vented, the Teflon mask is moved to expose a fresh surface area, and the surface holder is relocated to align the target area with the ion optical axis. After soft-landing, the Teflon mask is removed from the surface.

In another embodiment a linear ion trap can be used as a component of a soft-landing instrument. Ions travel through a heated capillary into a second chamber via ion guides in chambers of increasing vacuum. The ions are captured in the linear ion trap by applying suitable voltages to the electrodes and RF and DC voltages to the segments of the ion trap rods. The stored ions can be radially ejected for detection. Alternatively, the ion trap can be operated to eject the ions of selected mass through the ion guide, through a plate onto the microarray plate. The plate can be inserted through a mechanical gate valve system without venting the entire instrument.

The advantages of the linear quadrupole ion trap over a standard Paul ion trap include increased ion storage capacity and the ability to eject ions both axially and radially. Linear ion traps give unit resolution to at least 2000 Thomspon (Th) and have capabilities to isolate ions of a single mass/charge ratio and then perform subsequent excitation and dissociation in order to record a product ion MS/MS spectrum. Mass analysis will be performed using resonant waveform methods. The mass range of the linear trap (2000 Th or 4000 Th but adjustable to 20,000 Th) will allow mass analysis and soft-landing of most molecules of interest. In the soft-landing instrument described above the ions are introduced axially into the mass filter rods or ion trap rods. The ions can also be radially introduced into the linear ion trap.

Methods of operating the above described soft-landing instruments and other types of mass analyzers to soft-land ions of different masses at different spots on a microarray are now described. The ions of the functionalized analyte from the sample are introduced into the mass filter. Ions of selected mass-to-charge ratio will be mass-filtered and soft-landed on the substrate for a period of time. The mass-filter settings then will be scanned or stepped and corresponding movements in the position of the substrate will allow deposition of the ions at defined positions on the substrate.

The ions can be separated in time so that the ions arrive and land on the surface at different times. While this is being done the substrate is being moved to allow the separated ions to be deposited at different positions. A spinning disk is applicable, especially when the spinning period matches the duty cycle of the device. The applicable devices include the time-of-flight and the linear ion mobility drift tube. The ions can also be directed to different spots on a fixed surface by a scanning electric or magnetic fields.

In another embodiment, the ions can be accumulated and separated using a single device that acts both as an ion storage device and mass analyzer. Applicable devices are ion traps (Paul, cylindrical ion trap, linear trap, or ICR). The ions are accumulated followed by selective ejection of the ions for soft-landing. The ions can be accumulated, isolated as ions of selected mass-to-charge ratio, and then soft-landed onto the substrate. Ions can be accumulated and landed simultaneously. In another example, ions of various mass-to-charge ratios are continuously accumulated in the ion trap while at the same time ions of a selected mass-to-charge ratio can be ejected using SWIFT and soft-landed on the substrate.

In a further embodiment of the soft-landing instrument ion mobility, is used as an additional (or alternative) separation parameter. As before, ions are generated by a suitable ionization source, such as those described herein. The ions are then subjected to pneumatic separation using a transverse air-flow and electric field. The ions move through a gas in a direction established by the combined forces of the gas flow and the force applied by the electric field. Ions are separated in time and space. The ions with the higher mobility arrive at the surface earlier and those with the lower mobility arrive at the surface later at spaces or locations on the surface.

The instrument can include a combination of the described devices for the separation and soft-landing of ions of different masses at different locations. Two such combinations include ion storage (ion traps) plus separation in time (TOF or ion mobility drift tube) and ion storage (ion traps) plus separation in space (sectors or ion mobility separator).

It is desirable that the structure of the analyte be maintained during the soft-landing process. On such strategy for maintaining the structure of the analyte upon deposition involves keeping the deposition energy low to avoid dissociation or transformation of the ions when they land. This needs to be done while at the same time minimizing the spot size. Another strategy is to mass select and soft-land an incompletely desolvated form of the ionized molecule. Extensive hydration is not necessary for molecules to keep their solution-phase properties in gas-phase. Hydrated molecular ions can be formed by electrospray and separated while still "wet" for soft-landing. The substrate surface can be a "wet" surface for soft-landing, this would include a surface with as little as one monolayer of water. Another strategy is to hydrate the molecule immediately after mass-separation and prior to soft-landing. Several types of mass spectrometers, including the linear ion trap, allow ion/molecule reactions including hydration reactions. It might be possible to control the number of water molecules of hydration. Still further strategies are to deprotonate the mass-selected ions using ion/molecule or ion/ion reactions after separation but before soft-landing, to avoid undesired ion/surface reactions or protonate at a sacrificial derivatizing group which is subsequently lost.

Different surfaces are likely to be more or less well suited to successful soft-landing. For example, chemically inert surfaces which can efficiently remove vibrational energy during landing may be suitable. The properties of the surfaces will also determine what types of in situ spectroscopic identification are possible. The ions can be soft-landed directly onto substrates suitable for MALDI. Similarly, soft-landing onto SERS-active surfaces should be possible. In situ MALDI and secondary ion mass spectrometry can be performed by using a bi-directional mass analyzer such as a linear trap as the mass analyzer in the ion deposition step and also in the deposited material analysis step.

In another embodiment, ions may be collected in the ambient environment (ambient pressure but still under vacuum) without mass analysis (See Examples herein). The collected ions may then be subsequently analyzed by any suitable technique, such as infrared spectrometry or mass spectrometry.

Discontinuous Atmospheric Pressure Interface (DAPI)

In certain embodiments, ion focusing devices of the invention are used with discontinuous atmospheric interfaces. Discontinuous atmospheric interfaces are described in Ouyang et al. (U.S. Pat. No. 8,304,718 and PCT application number PCT/US2008/065245), the content of each of which is incorporated by reference herein in its entirety.

Figure 14:
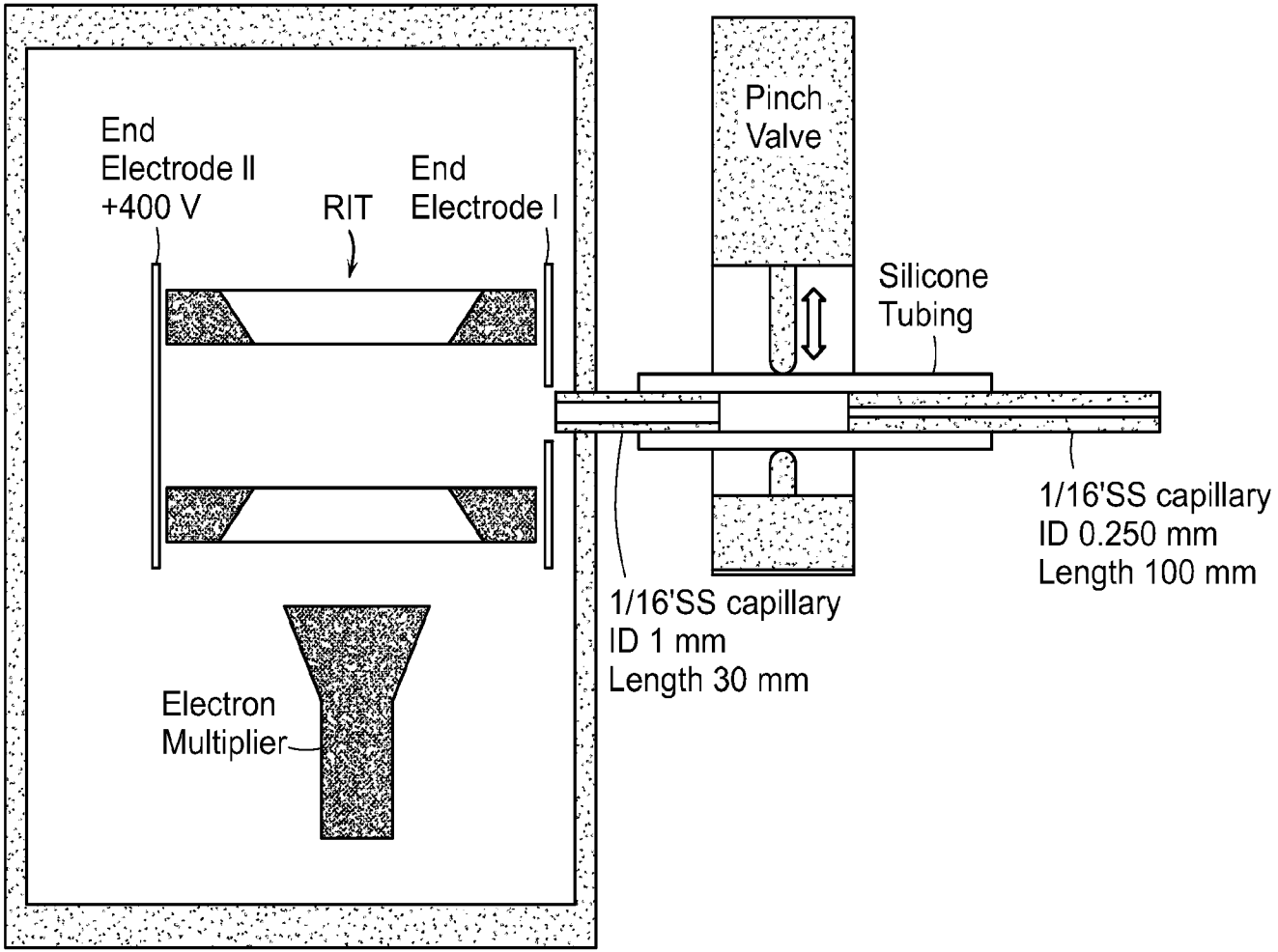
FIG. 14 is a schematic showing a discontinuous atmospheric pressure interface coupled in a miniature mass spectrometer with rectilinear ion trap.

An exemplary DAPI is shown in FIG. 14. The concept of the DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAPI opens and shuts down the airflow in a controlled fashion. The pressure inside the vacuum manifold increases when the API opens and decreases when it closes. The combination of a DAPI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between 10-3 to 10-10 torr depending the type of mass analyzer. The larger the opening in an atmospheric pressure interface, the higher is the ion current delivered into the vacuum system and hence to the mass analyzer.

An exemplary embodiment of a DAPI is described herein. The DAPI includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 m3/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump cannot be turned on. When the pinch valve is de-energized, the plastic tubing is squeezed closed and the turbo pump can then be turned on to pump the manifold to its ultimate pressure in the range of 1×10 5 torr.

The sequence of operations for performing mass analysis using ion traps usually includes, but is not limited to, ion introduction, ion cooling and RF scanning. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the RF voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10.

Desorption Electrospray Ionization

Desorption electrospray ionization (DESI) is described for example in Takats et al. (U.S. Pat. No. 7,335,897), the content of which is incorporated by reference herein in its entirety. DESI allows ionizing and desorbing a material (analyte) at atmospheric or reduced pressure under ambient conditions. A DESI system generally includes a device for generating a DESI-active spray by delivering droplets of a liquid into a nebulizing gas. The system also includes a means for directing the DESI-active spray onto a surface. It is understood that the DESI-active spray may, at the point of contact with the surface, include both or either charged and uncharged liquid droplets, gaseous ions, molecules of the nebulizing gas and of the atmosphere in the vicinity. The pneumatically assisted spray is directed onto the surface of a sample material where it interacts with one or more analytes, if present in the sample, and generates desorbed ions of the analyte or analytes. The desorbed ions can be directed to a mass analyzer for mass analysis, to an IMS device for separation by size and measurement of resulting voltage variations, to a flame spectrometer for spectral analysis, or the like.

Figure 15:
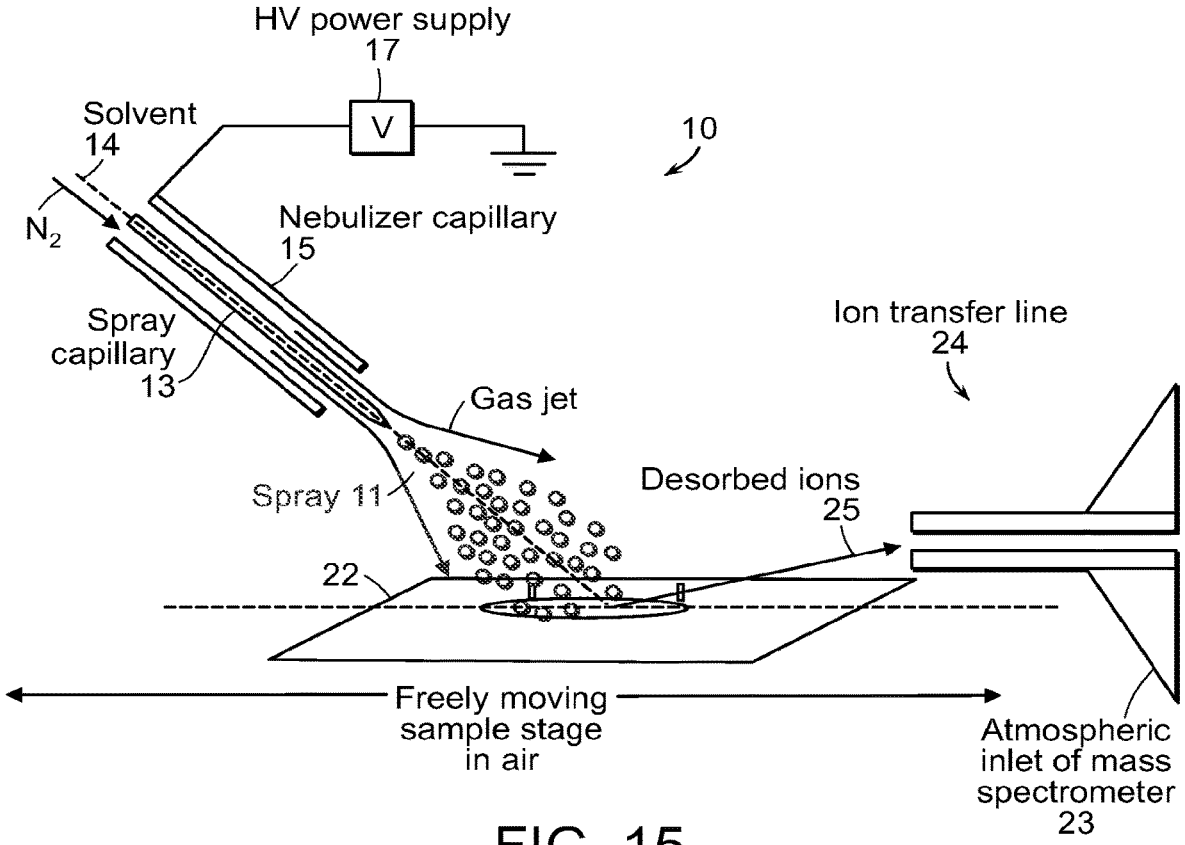
FIG. 15 is a schematic showing a spray device for generating and directing a DESI-active spray onto sample material (analyte) and for collecting and analyzing the resulting desorbed ions.

FIG. 15 illustrates schematically one embodiment of a DESI system 10. In this system, a spray 11 is generated by a conventional electrospray device 12. The device 12 includes a spray capillary 13 through which the liquid solvent 14 is fed. A surrounding nebulizer capillary 15 forms an annular space through which a nebulizing gas such as nitrogen ($N_2$) is fed at high velocity. In one example, the liquid was a water/methanol mixture and the gas was nitrogen. A high voltage is applied to the liquid solvent by a power supply 17 via a metal connecting element. The result of the fast flowing nebulizing gas interacting with the liquid leaving the capillary 13 is to form the DESI-active spray 11 comprising liquid droplets. DESI-active spray 11 also may include neutral atmospheric molecules, nebulizing gas, and gaseous ions. Although an electrospray device 12 has been described, any device capable of generating a stream of liquid droplets carried by a nebulizing gas jet may be used to form the DESI-active spray 11.

The spray 11 is directed onto the sample material 21 which in this example is supported on a surface 22. The desorbed ions 25 leaving the sample are collected and introduced into the atmospheric inlet or interface 23 of a mass spectrometer for analysis by an ion transfer line 24 which is positioned in sufficiently close proximity to the sample to collect the desorbed ions. Surface 22 may be a moveable platform or may be mounted on a moveable platform that can be moved in the x, y or z directions by well-known drive means to desorb and ionize sample 21 at different areas, sometimes to create a map or image of the distribution of constituents of a sample. Electric potential and temperature of the platform may also be controlled by known means. Any atmospheric interface that is normally found in mass spectrometers will be suitable for use in the invention. Good results have been obtained using a typical heated capillary atmospheric interface. Good results also have been obtained using an atmospheric interface that samples via an extended flexible ion transfer line made either of metal or an insulator.

Low Temperature Plasma Low temperature plasma (LTP) probes are described in Ouyang et al. (U.S. patent application Ser. No. 12/863,801 and PCT application number PCT/US09/33760), the content of each of which is incorporated by reference herein in its entirety. Unlike electrospray or laser based ambient ionization sources, plasma sources do not require an electrospray solvent, auxiliary gases, and lasers. LTP can be characterized as a non-equilibrium plasma having high energy electrons, with relatively low kinetic energy but reactive ions and neutrals; the result is a low temperature ambient plasma that can be used to desorb and ionize analytes from surfaces and produce molecular ions or fragment ions of the analytes. A distinguishing characteristic of the LTP, in comparison with high temperature (equilibrium) plasmas, is that the LTP does not breakdown the molecules into atoms or small molecular fragments, so the molecular information is retained in the ions produced. LTP ionization sources have the potential to be small in size, consume low power and gas (or to use only ambient air) and these advantages can lead to reduced operating costs. In addition to cost savings, LTP based ionization methods have the potential to be utilized with portable mass spectrometers for real-time analytical analysis in the field (Gao, L.; Song, Q.; Patterson, G. E.; Cooks, D. Ouyang, Z., Anal. Chem. 2006, 78, 5994-6002; Mulligan, C. C.; Talaty, N.; Cooks, R. G., Chemical Communications 2006, 1709-1711; and Mulligan, C. C.; Justes, D. R.; Noll, R. J.; Sanders, N. L.; Laughlin, B. C.; Cooks, R. G., The Analyst 2006, 131, 556-567).

Figure 16:
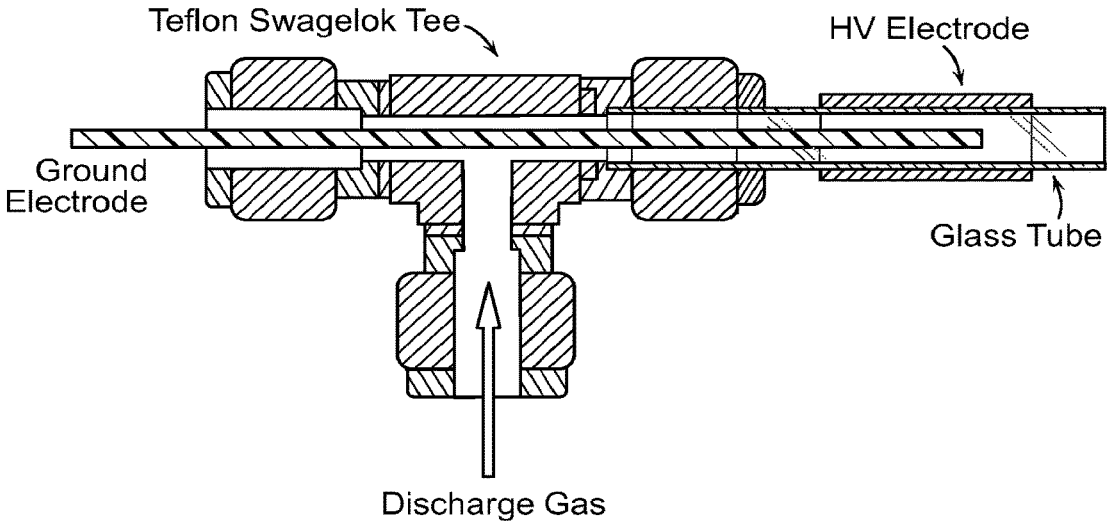
FIG. 16 is a schematic showing an embodiment of a low temperature plasma (LTP) probe.

An exemplary LTP probe is shown in FIG. 16. Such a probe may include a housing having a discharge gas inlet port, a probe tip, two electrodes, and a dielectric barrier, in which the two electrodes are separated by the dielectric barrier, and in which application of voltage from a power supply generates an electric field and a low temperature plasma, in which the electric field, or gas flow, or both, propel the low temperature plasma out of the probe tip. The ionization source of the probe described herein is based upon a dielectric barrier discharge (DBD; Kogelschatz, U., Plasma Chemistry and Plasma Processing 2003, 23, 1-46). Dielectric barrier discharge is achieved by applying a high voltage signal, for example an alternating current, between two electrodes separated by a dielectric barrier. A non-thermal, low power, plasma is created between the two electrodes, with the dielectric limiting the displacement current. This plasma contains reactive ions, electrons, radicals, excited neutrals, and metastable species in the ambient environment of the sample which can be used to desorb/ionize molecules from a solid sample surface as well as ionizing liquids and gases. The plasma can be extracted from the discharge region and directed toward the sample surface with the force by electric field, or the combined force of the electric field and gas flow.

In certain embodiments, the probe further includes a power supply. The power supply can provide direct current or alternating current. In certain embodiments, the power supply provides an alternating current. In certain embodiments, a discharge gas is supplied to the probe through the discharge gas inlet port, and the electric field and/or the discharge gas propel the low temperature plasma out of the probe tip. The discharge gas can be any gas. Exemplary discharge gases include helium, compressed or ambient air, nitrogen, and argon. In certain embodiments, the dielectric barrier is composed of an electrically insulating material. Exemplary electrically insulating materials include glass, quartz, ceramics and polymers. In other embodiments, the dielectric barrier is a glass tube that is open at each end. In other embodiments, varying the electric field adjusts the energy and fragmentation degree of ions generated from the analytes in a sample.

Ionization Using Wetted Porous Material

Figure 17A:
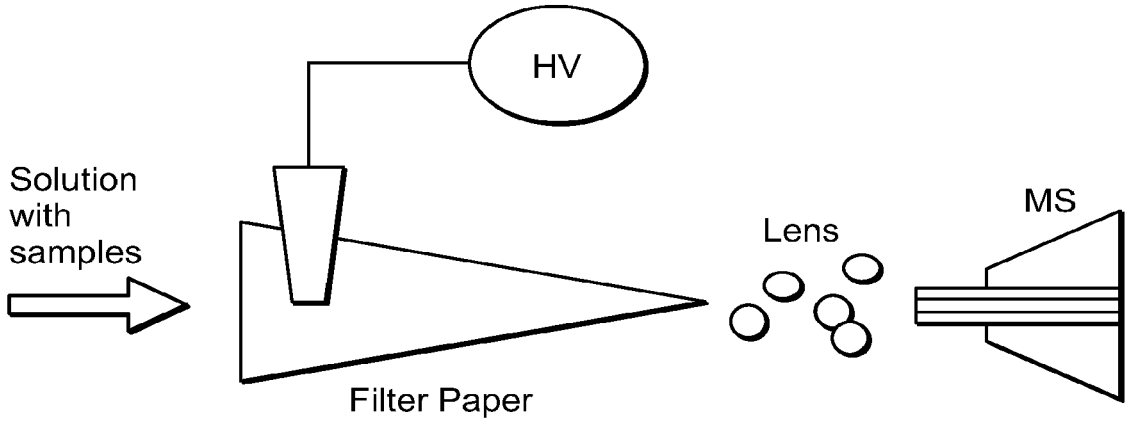
FIG. 17A is a schematic of a sample solution being fed to a piece of paper for electrospray ionization.
Figure 17B:
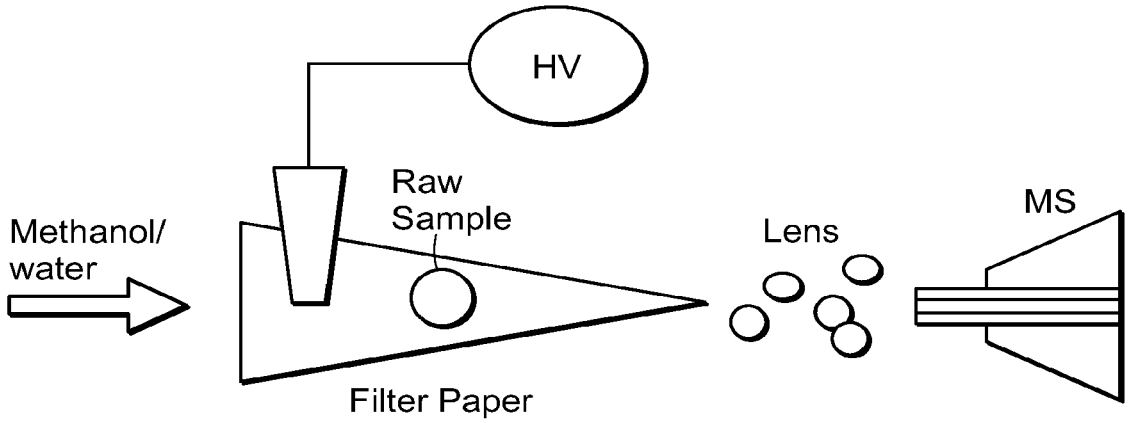
FIG. 17B is a schematic of a sample solution pre-spotted onto the paper and a droplet of solvent being subsequently supplied to the paper for electrospray ionization.

Probes comprised of porous material that is wetted to produce ions are described in Ouyang et al. (U.S. patent application Ser. No. 13/265,110 and PCT application number PCT/US10/32881), the content of each of which is incorporated by reference herein in its entirety. Exemplary probes are shown in FIGS. 17A-B. Porous materials, such as paper (e.g. filter paper or chromatographic paper) or other similar materials are used to hold and transfer liquids and solids, and ions are generated directly from the edges of the material when a high electric voltage is applied to the material. The porous material is kept discrete (i.e., separate or disconnected) from a flow of solvent, such as a continuous flow of solvent. Instead, sample is either spotted onto the porous material or swabbed onto it from a surface including the sample. The spotted or swabbed sample is then connected to a high voltage source to produce ions of the sample which are subsequently mass analyzed. The sample is transported through the porous material without the need of a separate solvent flow. Pneumatic assistance is not required to transport the analyte; rather, a voltage is simply applied to the porous material that is held in front of a mass spectrometer.

In certain embodiments, the porous material is any cellulose-based material. In other embodiments, the porous material is a non-metallic porous material, such as cotton, linen wool, synthetic textiles, or plant tissue. In still other embodiments, the porous material is paper. Advantages of paper include: cost (paper is inexpensive); it is fully commercialized and its physical and chemical properties can be adjusted; it can filter particulates (cells and dusts) from liquid samples; it is easily shaped (e.g., easy to cut, tear, or fold); liquids flow in it under capillary action (e.g., without external pumping and/or a power supply); and it is disposable.

In certain embodiments, the porous material is integrated with a solid tip having a macroscopic angle that is optimized for spray. In these embodiments, the porous material is used for filtration, pre-concentration, and wicking of the solvent containing the analytes for spray at the solid type.

In particular embodiments, the porous material is filter paper. Exemplary filter papers include cellulose filter paper, ashless filter paper, nitrocellulose paper, glass microfiber filter paper, and polyethylene paper. Filter paper having any pore size may be used. Exemplary pore sizes include Grade 1 (11 μm), Grade 2 (8 μm), Grade 595 (4-7 μm), and Grade 6 (3 μm). Pore size will not only influence the transport of liquid inside the spray materials, but could also affect the formation of the Taylor cone at the tip. The optimum pore size will generate a stable Taylor cone and reduce liquid evaporation. The pore size of the filter paper is also an important parameter in filtration, i.e., the paper acts as an online pretreatment device. Commercially available ultrafiltration membranes of regenerated cellulose, with pore sizes in the low nm range, are designed to retain particles as small as 1000 Da. Ultra filtration membranes can be commercially obtained with molecular weight cutoffs ranging from 1000 Da to 100,000 Da.

Probes of the invention work well for the generation of micron scale droplets simply based on using the high electric field generated at an edge of the porous material. In particular embodiments, the porous material is shaped to have a macroscopically sharp point, such as a point of a triangle, for ion generation. Probes of the invention may have different tip widths. In certain embodiments, the probe tip width is at least about 5 μm or wider, at least about 10 μm or wider, at least about 50 μm or wider, at least about 150 μm or wider, at least about 250 μm or wider, at least about 350 μm or wider, at least about 400μ or wider, at least about 450 μm or wider, etc. In particular embodiments, the tip width is at least 350 μm or wider. In other embodiments, the probe tip width is about 400 μm. In other embodiments, probes of the invention have a three dimensional shape, such as a conical shape.

As mentioned above, no pneumatic assistance is required to transport the droplets. Ambient ionization of analytes is realized on the basis of these charged droplets, offering a simple and convenient approach for mass analysis of solution-phase samples. Sample solution is directly applied on the porous material held in front of an inlet of a mass spectrometer without any pretreatment. Then the ambient ionization is performed by applying a high potential on the wetted porous material. In certain embodiments, the porous material is paper, which is a type of porous material that contains numerical pores and microchannels for liquid transport. The pores and microchannels also allow the paper to act as a filter device, which is beneficial for analyzing physically dirty or contaminated samples. In other embodiments, the porous material is treated to produce microchannels in the porous material or to enhance the properties of the material for use as a probe of the invention. For example, paper may undergo a patterned silanization process to produce microchannels or structures on the paper. Such processes involve, for example, exposing the surface of the paper to tridecafluoro-1,1,2,2-tetrahydrooctyl-1-trichlorosilane to result in silanization of the paper.

In other embodiments, a soft lithography process is used to produce microchannels in the porous material or to enhance the properties of the material for use as a probe of the invention. In other embodiments, hydrophobic trapping regions are created in the paper to pre-concentrate less hydrophilic compounds. Hydrophobic regions may be patterned onto paper by using photolithography, printing methods or plasma treatment to define hydrophilic channels with lateral features of 200-1000 μm. See Martinez et al. (Angew. Chem. Int. Ed. 2007, 46, 1318-1320); Martinez et al. (Proc. Natl Acad. Sci. USA 2008, 105, 19606-19611); Abe et al. (Anal. Chem. 2008, 80, 6928-6934); Bruzewicz et al. (Anal. Chem. 2008, 80, 3387-3392); Martinez et al. (Lab Chip 2008, 8, 2146-2150); and Li et al. (Anal. Chem. 2008, 80, 9131-9134), the content of each of which is incorporated by reference herein in its entirety. Liquid samples loaded onto such a paper-based device can travel along the hydrophilic channels driven by capillary action.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Ion focusing is achieved at atmospheric pressure using elliptical or cylindrical ion mirrors. Working at a fixed distance from an ion source to a mass analyzer entrance aperture, the elliptical electrode increases ion currents in the mass spectrometer by a factor of a hundred. The ion transport efficiency, measured by soft landing ionized dyes, collecting the resulting dye, and measuring its absorbance, is estimated to be 75% under typical focusing conditions. Simulations of ion motion using SIMION 8.0 reasonably predicted the performance of the ion lenses in air. Ion current measurements and spatial profiling of the focused beams were facilitated by use of a commercial ionCCD detector that operates in air and in which charge is measured as a function of position. That allowed the effects of operating parameters on beam shape and intensity to be measured. The results achieved speak to the effects of both pneumatic and electrical forces in directing ions, which can be done with good control, both for unsolvated ('dry') ions and also for charged microdroplets. Notable also is the fact that the simple cylindrical lens gave similar performance to the elliptical ion mirror. The effects of turbulence in the primary ion beam were also characterized.

Ions are normally transported and manipulated in vacuum. Nevertheless, the ability to efficiently transport and spatially manipulate ions at atmospheric pressure is an emerging topic of interest in a variety of fields. Of particular interest are modifications to surfaces made using low energy molecular ion beams (Wang et al., Angew. Chem. Int. Ed. 2008, 47, (35), 6678-6680; Lim et al. Kim, Y D. Chem. Phys. Lett. 2007, 439, (4-6), 364-368; Tepavcevic et al. J. Phys. Chem. B 2005, 109, (15), 7134-7140; Lee et al. J.; Vajda, S. Angew. Chem. Int. Ed. 2009, 48, (8), 1467-1471; Rader et al. Nat Mater 2006, 5, (4), 276-280; Thontasen et al. J. Phys. Chem. C 2010, 114, (41), 17768-17772; Cyriac et al. Chem. Rev. 2012, Submitted; Kitching et al. Rev. Sci.

Instrum. 2003, 74, (11), 4832-4839; and oln et al. Anal. Chem. 2005, 77, (15), 4890-4896), examples of which now include cases in which the ion/surface interaction occurs at atmospheric pressure Badu-Tawiah et al. J. Am. Soc. Mass. Spectrom. 2012, 23, (5), 842-849; and Badu-Tawiah et al. Anal. Chem. 2011, 83, (7), 2648-2654). Applications include the chemical functionalization ('tailoring') of surfaces (Johnson et al. J. Annu. Rev. Anal. Chem. 2011, 4, (1), 83-104; and Ratner et al. US2003/0157269). and the preparation of thin films (Hanley et al. Surf. Sci. 2002, 500, (1-3), 500-522; and Ifa, Analyst 2010, 135, (4), 669-681). While thin film preparation typically uses exposure to highly controlled yet poorly characterized plasmas (National Research Council, S. Plasma Processing of Materials: Scientific Opportunities and Technological Challenges; 9780309583756; National Academies Press: Washington, D.C., USA, 1991), polymer film deposition using ion beam conditioning has become increasingly common (Wroble et al., Thin Solid Films 2008, 516, (21), 7386-7392).

Another general application area of atmospheric pressure ions, analytical mass spectrometry, has seen particularly rapid development. This is due to the introduction of ambient ionization methods in which samples are examined in their native state in the ambient environment. A variety of means including spray, laser, and plasma techniques are being used to sample the material and to create representative ions (Weston, Analyst 2010, 135, (4), 661-668; and Huang et al., Annu. Rev. Anal. Chem. 2010, 3, (1), 43-65). The growth of interest in utilizing ion beams in the ambient environment raises obvious concerns regarding ion transport and focusing at atmospheric pressure. Progress has been made in regards to ion transport through understanding of the factors that limit the efficiency. This understanding has come both empirically (transport over several meters of ions generated by desorption electrospray ionization, and their delivery to a mass analyzer (Cotte-Rodriguez et al., Chem. Commun. 2006, (28), 2968-2970)) and through fluid dynamics simulations (Garimella et al., J. Mass Spectrom. 2012, 47, (2), 201-207). These simulations have confirmed that once laminar flow is established in a transport tube, modest suction will move typical organic ions long distances through air without significant losses.

The issue of ion focusing in air is both less explored and has importance beyond the ambient ionization methods. In particular, all forms of spray ionization, including electrospray ionization (ESI), yield droplets, the fission of which results in a highly dispersed spray plume in which the ion concentration decreases rapidly with distance from the source (Page et al., J. Am. Soc. Mass. Spectrom. 2007, 18, (9), 1582-1590). This undesirable effect is compounded by the fact that the droplets undergo further fission and desolvation before producing gas phase ions that are detectable by the mass spectrometer. Increased distances are needed for more effective desolvation (Fenn et al., M. Mass Spectrom. Rev. 1990, 9, (1), 37-70; and Kebarle et al., Anal. Chem. 1993, 65, (22), 972A-986A). On the other hand, the small sampling orifices (generally 1 mm or less, inner diameter) needed for vacuum compatibility greatly restrict the fraction of ions that may be sampled from the spray plume. Because of these factors, the efficiency with which ions are collected is a small fraction of the total number of ions produced (often <0.1%) (Cech et al., Mass Spectrom. Rev. 2001, 20, (6), 362-387). Multipole ion guides based on collisional focusing by applied radio frequency (RF) fields have been utilized successfully to increase transport efficiency in the low pressure regime (0.1-10 mtorr) but are not effective at atmospheric pressure (Douglas et al., J. Am. Soc. Mass. Spectrom. 1992, 3, (4), 398-408; and Tolmachev et al., Nucl. Instrum. Methods Phys. Res., Sect. B 1997, 124, (1), 112-119). Electrodynamic ion funnels that consist of stacked ring electrodes of decreasing diameter to which DC and RF potentials are applied have been shown to improve sensitivity more than 10 fold in some cases when used in the first differentially pumped regions of a mass spectrometer. However, the ion funnel is only effective in the pressure range of 0.1-30 torr and is a mechanically complex device (Kelly et al., Mass Spectrom. Rev. 2010, 29, (2), 294-312).

As the majority of ion loss takes place at the atmospheric pressure interface of a mass spectrometer, improvement in transport from ambient pressure to the first differentially pumped region is needed to improve sensitivity significantly.

These Examples describes the use of simple elliptical and cylindrical electrodes to which DC potentials (and sometimes only DC potentials) are applied to facilitate the efficient transport and focusing of ions at atmospheric pressure. Consideration is given to ions produced by ion sources which have low solvent flow rates, typified by nanoESI. The focal properties of the electrode systems are explored through the use of a detector that operates at ambient pressure. Quantitative measurements of ion transfer efficiency are made using ionized dyes which, after soft landing onto a surface, can be rinsed off and determined spectrophotometrically. When interfaced to the atmospheric pressure inlet of a mass spectrometer the ion optical system described here is shown to increase ion transport efficiency by a factor of 100 over distances of several centimeters.

Example 1: Chemicals and Instrumentation

A Thermo LTQ ion trap mass spectrometer (Thermo Scientific, San Jose, Calif., USA) was used to record mass spectra over the range of m/z 100-2000. Mass calibration employed LTQ calibration mix containing Ultramark 1621, caffeine, and MRFA peptide for positive ion spectra. A mixture of the positive ion calibration solution, sodium dodecyl sulfate, and sodium taurocholate was used to calibrate negative ion spectra. These solutions were prepared according to procedures in the LTQ user manual. An ION-CCD (pixel CCD array detector, OI Analytical) detector system (OI Analytical, Pelham, Ala., USA) was used to profile the spatial distributions of ions at atmospheric pressure. Solutions of rhodamine B in 8:2 methanol:water (v:v) were used for transport efficiency experiments. Absorption data were collected on a Cary 300 UV-Visible spectrophotometer (Agilent Technologies, Santa Clara, Calif., USA). All chemicals were purchased from Sigma-Aldrich (St. Louis, Mo., USA).

Example 2: Ion Transport Apparatus

Figure 4B:
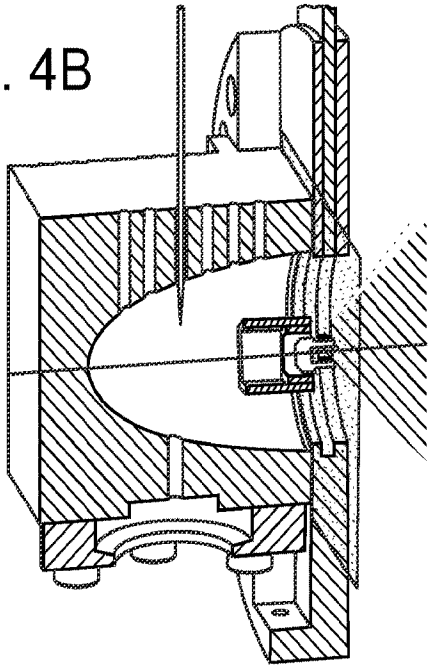
FIGS. 4A-4C show cutaway views of three different systems used to transport and focus ion beams.
Figure 4C:
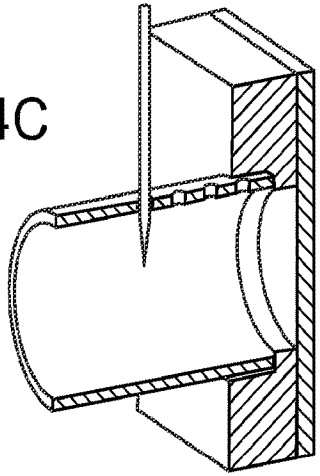
Figure 4A:
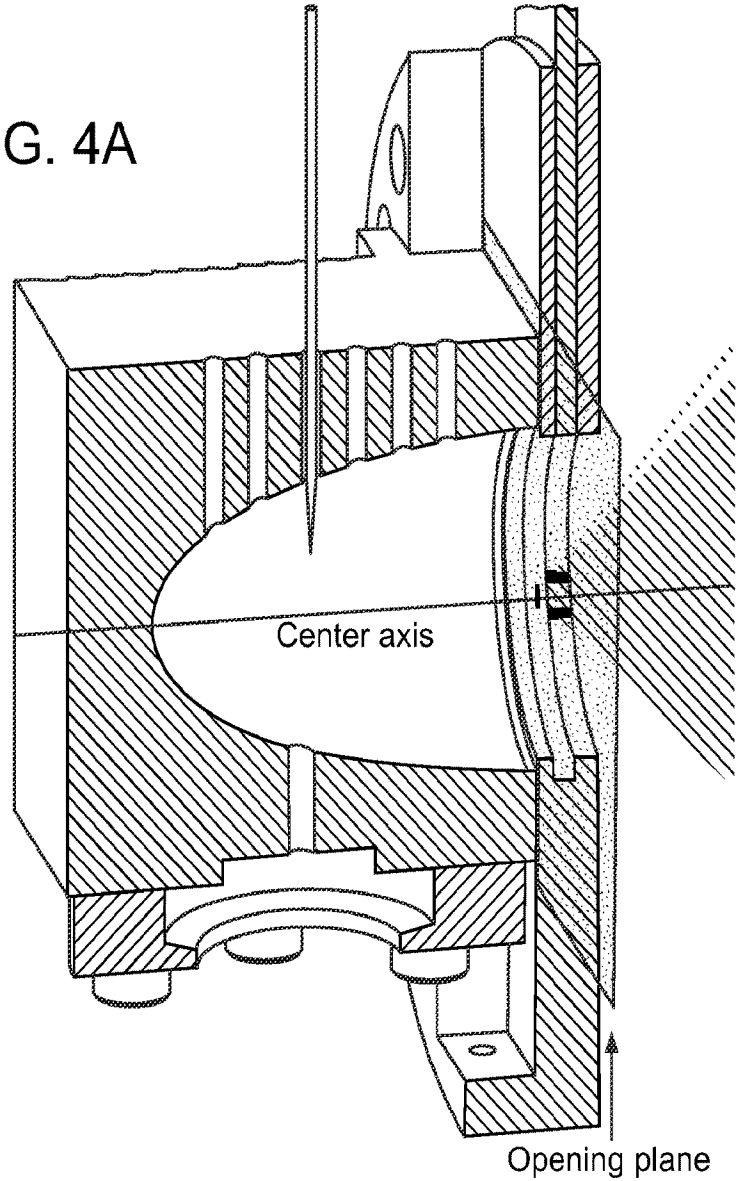

FIGS. 4A-4C shows cutaway views of three different systems used to transport and focus ion beams in these Examples. The first (FIG. 4A) consists of a steel block with a half-ellipsoidal cavity. The second (FIG. 4B) is a variation on the first with two cylindrical copper electrodes placed on axis of the cavity. The third device tested (FIG. 4C) simply employs a cylindrical copper electrode. In each case the spray tip was placed inside the electrode and held at a potential that was different from the electrode to allow creation of ions inside the focusing device. An aluminum plate was used as a grounding electrode and was placed in close proximity to the opening of the focusing device from which it was separated by a polyether ether ketone (PEEK)

spacer. Unless stated otherwise, the spacing between the ellipse opening plane and the aluminum plate was 2 mm. The elliptical electrode also included a gas inlet and connections to allow studies on the effect of turbulent flow on ion transport. For gas flow investigations, a flow of nitrogen was provided from a compressed gas cylinder.

Example 3: Spatial Profiling of Ion Distribution

Spatially resolved ion detection at atmospheric pressure was accomplished through the use of an IONCCD (pixel CCD array detector, OI Analytical) detector. The IONCCD (pixel CCD array detector, OI Analytical) consists of an array of 21 μm wide TiN pads or pixels (2126 active pixels) 1.5 mm in height, separated by 3 μm, giving a pitch or spatial resolution of 24 μm. The pixel array and electronics were housed in a grounded stainless steel box with a 1.5 mm wide, 49 mm long opening slit exposing the pixel array. As ions came in contact with the floated electrode surface they were neutralized and the charge was stored over a user-determined integration time (t). Integration times for all Examples were 100 ms. Following the integration time where all pixels acquire the respective charge simultaneously, the charges were read from each pixel serially and the position, time, and intensity was recorded. Intensity (J) is reported as digital numbers (dN), each dN corresponding to approximately 100 incoming elementary charges. Knowing this, the current (I) on each pixel was determined by:

$$I = \frac{100eJ}{t}$$

where e is the elementary charge constant. For operation under ambient conditions with no signal averaging typical background intensities are approximately 10 dN. A more detailed description of the operation of the detector is provided by Hadjar et al. (J. Am. Soc. Mass. Spectrom. 2011, 22, (4), 612-623).

The ion beam exiting the ellipse was profiled by replacing the grounded aluminum plate of the elliptical electrode with the IONCCD (pixel CCD array detector, OI Analytical) detector. The detector was mounted on a 3-axis manual moving stage (Parker Hannifin Corporation, Rohnert Park, Calif., USA) to allow for precise adjustment to obtain ion beam profiles at different positions. Electrode and sprayer potentials in the range of 0-7 kV were each varied independently to determine the effect of each on the intensity and spatial distribution of ions exiting the transport electrodes. Turbulent gas flow was also incorporated in some cases to examine its effect on ion spatial distribution and intensity.

Example 4: Transport Efficiency

Ion transport properties of the elliptical electrode were studied by spraying a known amount of rhodamine B solution at different distances from the counter electrode with and without the use of the elliptical electrode. Created ions were directed to and collected on the grounded aluminum plate. The material deposited on a square 1 $cm^2$ area corresponding to the most intense region of each deposited spot was re-dissolved in 1:1 methanol:water (v) and the solutions were analyzed for concentration by UV-vis spectrophotometry, by employing standards of known concentration to construct a calibration curve. The solutions had a maximum absorbance at a wavelength of 550 nm with a molar absorptivity of 105700 $M^{-1}$ $cm^{-1}$.

Example 5: Simulation of Ion Trajectories

Simulation of ion trajectories within the electrode structure was accomplished through the use of the statistical diffusion simulation (SDS) model included in the SIMION 8.0 example folders. The SDS program simulates diffusion by "jumping" ions a calculated distance, in a random direction, at each time step. The jump radius is calculated from the expected number of collisions each ion will encounter in the time period and a square root scaling based on interpolations between tables of data on collisional statistics. This jump radius is superimposed on ion motion due to the mobility (K) of an ion in the local electric field and drag effects from viscous gas flow. A detailed description of the SDS algorithm is given by Appelhans et al. (Int. J. Mass spectrom. 2005, 244, (1), 1-14). SDS provides a more computationally efficient simulation when working at or near atmospheric pressure compared to methods considering discreet collisions. The implementation of the SDS algorithm into the SIMION workspace has been shown to be an accurate predictor for ion motion at or near atmospheric pressure and has been validated experimentally in several cases including traditional drift cell ion mobility spectrometry (IMS) and high field asymmetric waveform ion mobility spectrometry (FAIMS)(Lai et al., Int. J. Mass spectrom. 2008, 276, (1), 1-8; Prasad et al., Anal. Chem. 2009, 81, (21), 8749-8757; and Wissdorf et al., Am. Soc. Mass. Spectrom. 2012, 23, (2), 397-406).

Example 6: Mass Spectrometer Interface

The electrodes were coupled to the atmospheric pressure inlet (API) of the mass spectrometer by drilling a 2.28 mm hole through the aluminum plate and inserting the 3.15 mm protrusion of the 2.36 mm outer diameter API capillary. In some cases a plastic ring was used to electrically isolate the API capillary from the ground plate; alternatively, the capillary was placed in contact with the plate. In the case where no plastic ring was used for electrical isolation the voltage on the capillary, as set in the LTQ software, was 15 V and electrical contact caused the potential on the aluminum plate to match this. Spectra were identical whether the plastic spacer was used and the plate was grounded or if electrical contact provided the 15 V potential. Spectra of the calibration solution in positive and negative mode were taken and the intensities of different ions were recorded as a function of different parameters including the potentials applied to each component and the distance of the sprayer tip from the ground plate and center axis of the ellipse.

Example 7: Ion Transport and Beam Profiling

The electrode geometry shown in FIG. 4A was used to test the dependence of transport properties on the potentials applied to the ellipse and sprayer. The major and minor radii of the cross-section of the half-elliptical cavity were 4.3 and 1.8 cm respectively. Holes were drilled along the major axis at different distances from the opening plane (see FIG. 4A) to allow the insertion of nanoESI capillaries at different positions along the axis of the cavity. Potentials ranging from 1 to 6 kV were applied to the ellipse while the spray voltage was offset from these values by an additional 0.6 to 3 kV.

Figure 5:
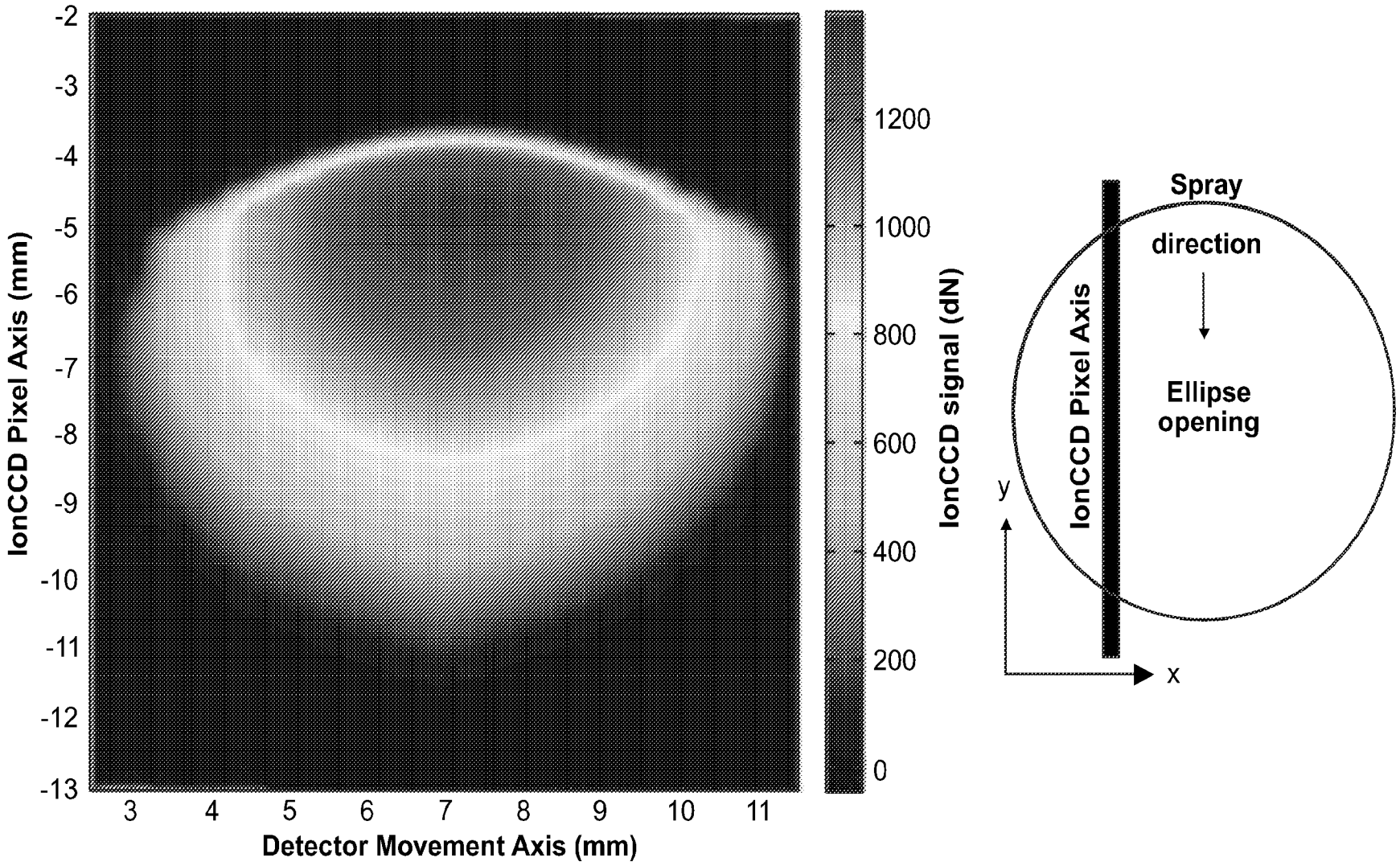
FIG. 5 shows intensity profile of ion beam exiting ellipse in arrangement shown in FIG. 4A. Potentials on ellipse and sprayer were 4 kV and 5 kV, respectively. Setup for profiling investigation is shown in the right segment of the figure.
Figure 6A:
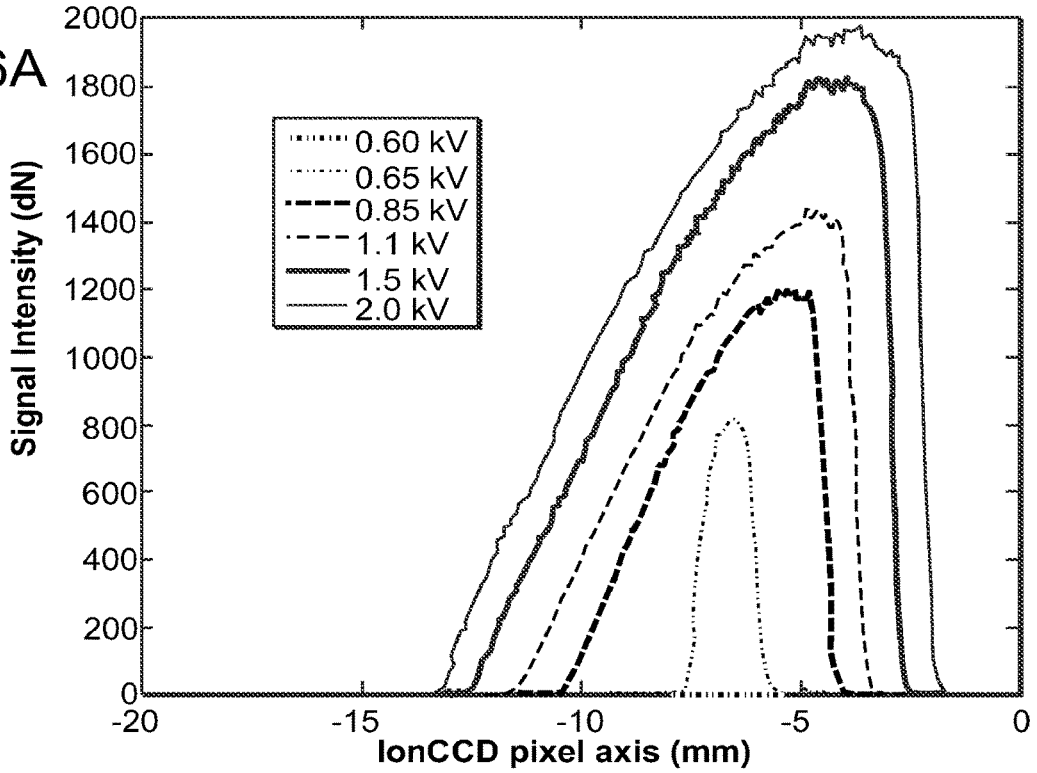
FIG. 6A is a graph showing an ion intensity profile at different offset voltages.
Figure 6B:
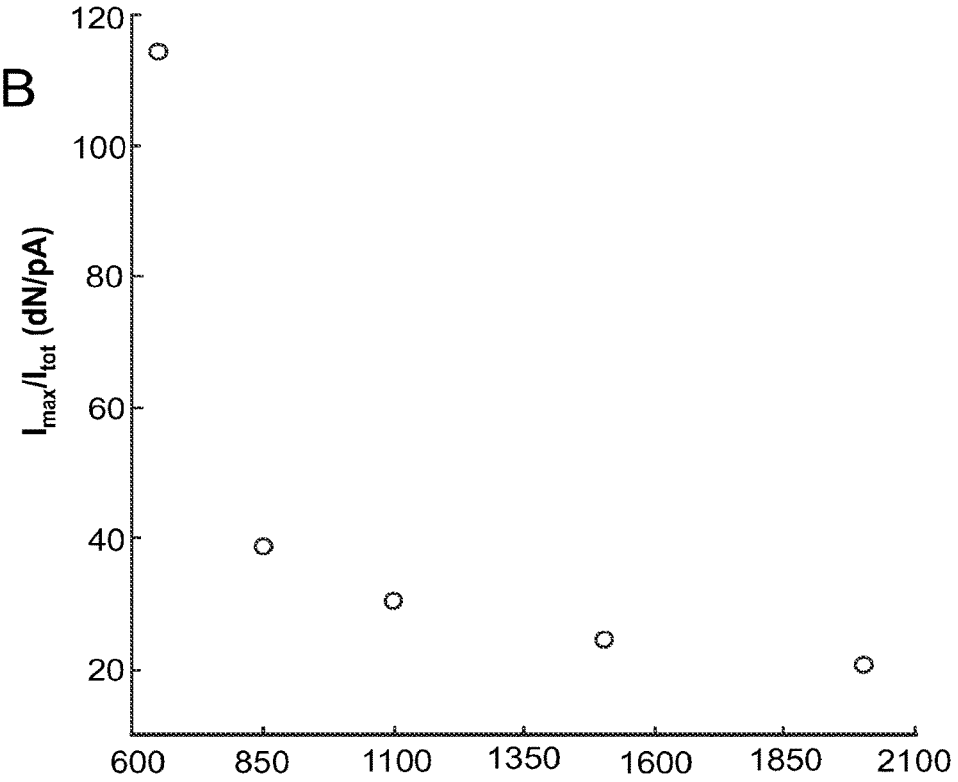
FIG. 6B is a graph showing Maximum IONCCD (pixel CCD array detector, OI Analytical) signal (Imax) over total current (Itot) for different offset potentials. Potential applied to ellipse was 4 kV and sprayer was 25 mm from ellipse opening plane for values shown. Spray direction corresponds to decreasing values on the IONCCD (pixel CCD array detector, OI Analytical) pixel axis. The arrangement in FIG. 4 panel A was used.

The full profile of the ion beam exiting the ellipse was determined by mounting the IONCCD (pixel CCD array detector, OI Analytical) with the pixel axis parallel to the y-axis of the ion beam and scanning in the x direction. This investigation, including the ionization, ion transport and detection steps was done in air. For this investigation, the elliptical electrode and sprayer were held at potentials of 4 kV and 5 kV respectively while the sprayer was 25 mm from the opening plane of the ellipse. The instrument calibration mixture was used as the spray solution in all cases. The intensity profiles (dN) at each x position were reconstructed to create a two-dimensional contour plot of ion intensity exiting the ellipse as is shown in FIG. 5. The resulting intensity plot indicates that the highest ion intensity occurs in the region nearest the spray tip. FIG. 6 illustrates the effect the offset voltage (spray potential—ellipse potential) has on both the intensity and spatial distribution of ions exiting the ellipse. Cross-sections (through center of ellipse, perpendicular to x-axis of FIG. 5) of spatially resolved ion intensity were recorded using the IONCCD (pixel CCD array detector, OI Analytical) while the elliptical electrode was held at a constant potential of 4 kV and the sprayer was positioned 25 mm from the opening plane of the ellipse. The spray potential was varied from 4.6 to 6 kV, corresponding to offset potentials of 0.6 to 2 kV. Increasing the offset potential resulted in a clear increase in ion intensity and also in a broadening of the intensity distribution. This broadening was likely due to the electrical fields created by the high potential at the sprayer tip. Quantification of the focal abilities of the electrode at different potentials was accomplished by considering the relation of maximum recorded intensity over total current (Imax/Itot) to the applied potential. A plot of this is shown in FIG. 6B. A better focus was observed as the potential offset was decreased. Additionally, the asymmetric nature of the ion distribution was almost entirely eliminated at low potentials compared to the distributions obtained at higher offset potentials. While a smaller number of ions were created, the better focus allowed a larger percentage of ions to be sampled by a mass spectrometer, improving overall efficiency and reducing the sample volume needed for analysis.

The effect of turbulent flow on the focal and transport properties of the device was examined by adding a nitrogen flow from a compressed gas cylinder. The pressure of the nitrogen line as determined by the regulator was approximately 5 psi and the interior of the device was assumed to be at atmospheric pressure. Spatial ion distributions were recorded by the IONCCD (pixel CCD array detector, OI Analytical) at different offset potentials while the ellipse potential was held constant. Results of these experiments show an increased intensity and an increased symmetry in the ion beam cross-section; however, the better focus at low offset potentials was not observed. Two possible reasons for the increase in intensity are the turbulent-aided desolvation of charged droplets (Birouk et al., Prog. Energy Combust. Sci. 2006, 32, (4), 408-423) and the transport of ions and charged microdroplets from areas of low electric field strengths to those of higher strength. The size of charged droplets makes them inherently less mobile than free ions, and as such they are influenced by electric field strengths to a smaller extent.

Example 8: Focusing Devices with Different Geometry

Spot sizes less than 1 mm in diameter were achieved when copper cylinders of decreasing diameter were placed coaxially inside the ellipse and against the ground plate as can be seen in FIG. 4B. A cylinder of smaller diameter was supplied with a lower potential, producing a voltage gradient to extract ions from the ellipse into the largest copper cylinder and in turn into the smallest of the cylinders. Ion loss was apparent in the simulation of this geometry and was evidenced in the experiments as rhodamine dye was seen on the opening of the larger of the two cylinders after spraying a 1 mM solution for several minutes. In another experiment, a cylinder was used in place of the elliptical electrode to determine the effect the electrode shape has on the spot morphology and focus. Holes were drilled in a copper cylinder (inner diameter 1 inch) so that a nanoESI emitter could be inserted into the interior of the electrode (FIG. 4C). Intensity profiles of ions exiting the copper cylinder showed a similar distribution as those exiting the elliptical electrode. Widths of the intensity profiles produced using the copper cylinder were slightly smaller than those obtained using the ellipse, demonstrating the effect of exit diameter on the focal properties of the electrodes. However, it must be taken into account that the smaller diameter results in a smaller penetration depth of the electric field into the electrode. Because of this, the depth of ion extraction from the electrode would be decreased.

Figure 12A:
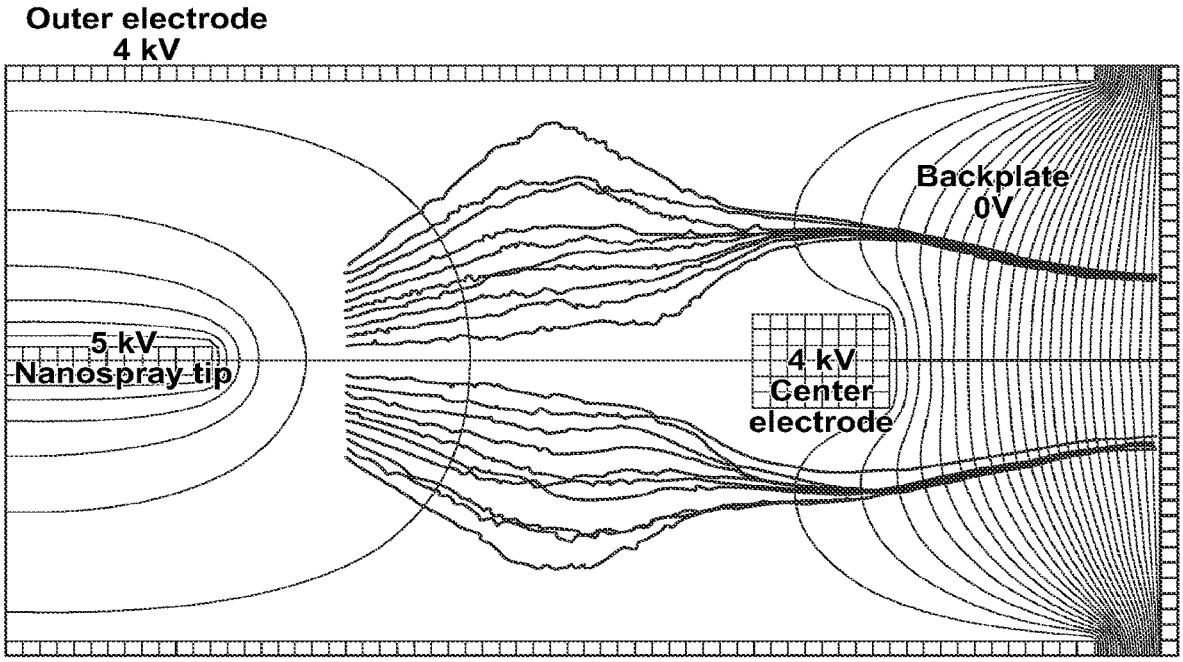
FIG. 12A shows a cylindrically symmetric SIMION-SDS simulation of the trajectories of ions (black lines) within a hollow cylinder containing a coaxial, solid cylindrical electrode with equipotential contour lines drawn in red.
Figure 12B:
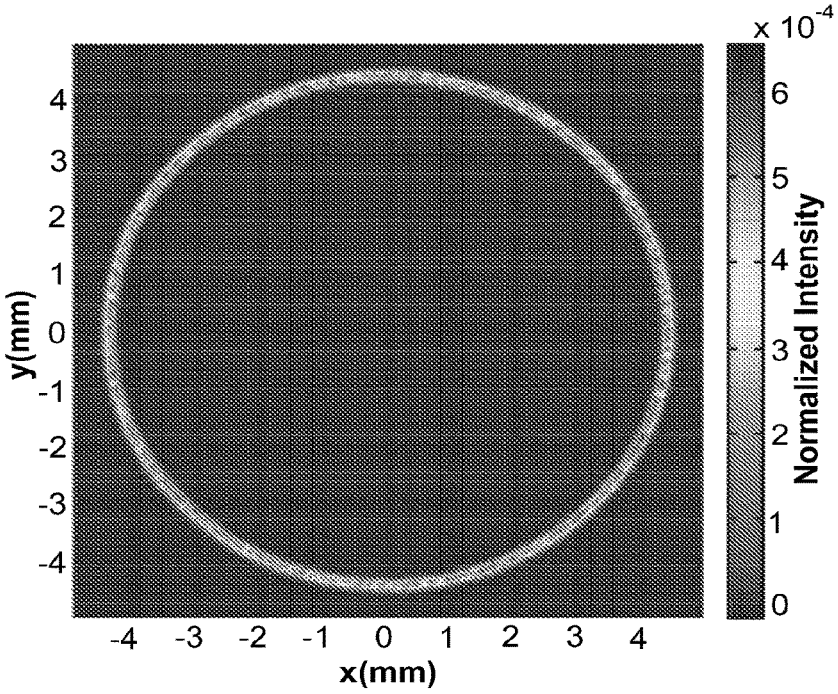
FIG. 12B shows a contour plot of ion intensities at the grounded back plate for the coaxial cylinder arrangement. Potentials applied in both figures are denoted in FIG. 12A.
Figure 13A:
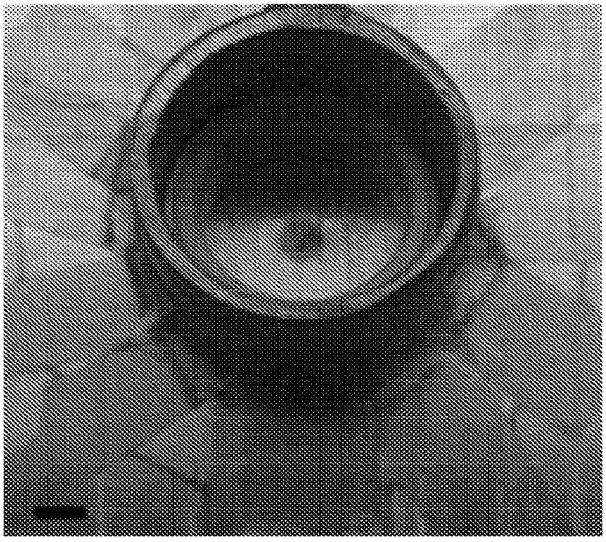
FIG. 13A is a photograph of a grounded aluminum plate with an attached coaxial copper cylinder.
Figure 13B:
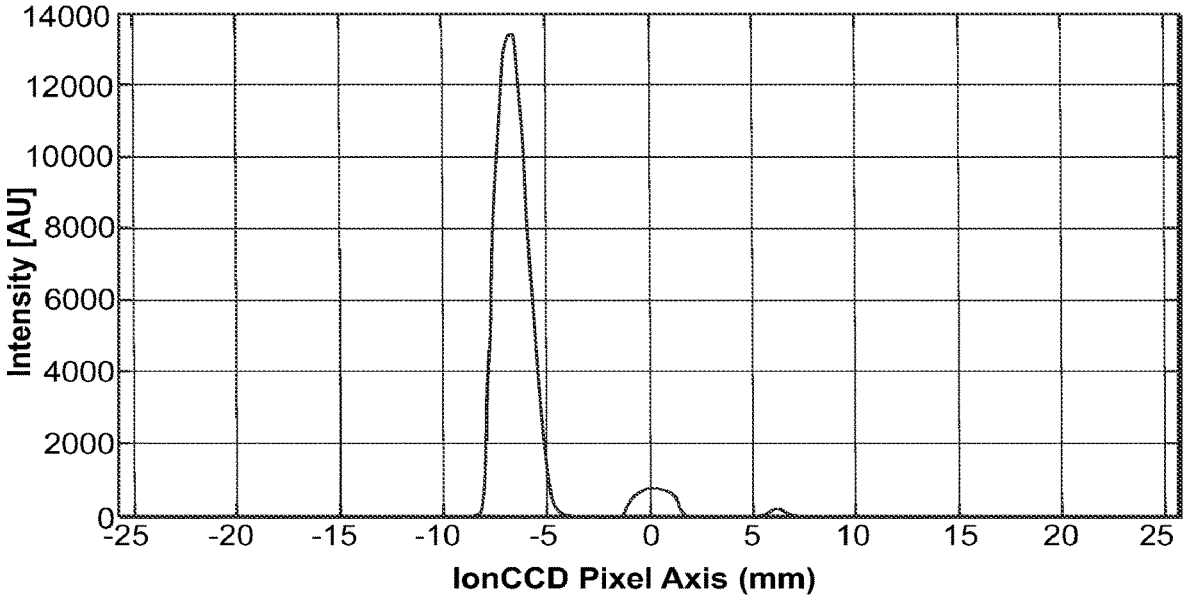
FIG. 13B shows IONCCD (pixel CCD array detector, OI Analytical) signal from electrode arrangement shown in FIG. 12B without the inner-most copper cylinder. In both cases the potentials applied to the sprayer, ellipse, and copper cylinder were 5.1, 4, and 3.7 kV, respectively. 1:1 methanol:water was used as the spray solution in panel B. Scale bar is 2 mm.

An interesting observation was made while performing the simulation of trajectories within the ellipse with the addition of an on-axis copper cylinder (See FIG. 4B). As the potential applied to the inner cylinder was raised to match that of the ellipse, ions would divert from the center and instead go around the cylinder to impact the grounded aluminum plate. On closer inspection it was discovered that ions following this path were radially focused to form a well-defined ring on the grounded plate. This type of behavior was explored by the simulation of ion trajectories within a hollow cylinder containing a solid, smaller cylindrical electrode on the center axis. Trajectories of ions within this geometry are shown in FIG. 12A and a contour plot of ion intensity at the back plate is shown in FIG. 12B. The same behavior was observed during rhodamine B deposition if the copper cylinder was held at a potential close to that of the ellipse (FIG. 13A). As a third form of verification, the IONCCD (pixel CCD array detector, OI Analytical) was used as the counter-electrode to observe this effect and determine the intensity of ions within this ring. Surprisingly, the intensity observed from the focused ring of ions was much more intense than the focus from the center spot in the on-axis copper electrode (FIG. 13B), yet only represented a 1.5 mm slice of the radially focused beam.

It should be noted that the asymmetric nature of the radially focused beam is likely caused by the wire welded to the top of the copper electrode. This connection disrupts the focal nature of the device as observed by the IONCCD (pixel CCD array detector, OI Analytical). If the radius of the circularly focused beam is taken as the distance between the position of maximum intensity of the peaks to the left and right of the center position in FIG. 13B, the total intensity of the beam can be estimated. This is done by calculating the current due to the peak centered at −7 mm, assuming the ideal case of a homogenous field (no wire connection), and taking into account the fraction of total ions represented by the 1.5 mm section of the circumference of the radially focused beam. Utilizing this procedure, the total current is estimated to be 4.6 nA.

These values show that the current obtained by the axial focusing lens system is more than 12 times that from the ellipse alone. This enhancement is likely a large underestimate as well, considering that many ions are lost to the walls of the inner copper cylinder in addition to those being focused in the center of the copper cylinder.

The circular focus observed in these experiments could lend itself well to applications in which the inlet of a mass spectrometer is altered from a circular hole to a ring opening in order to collect ions focused in this manner. Additionally, the ring of focused ions may see use as a method of highlighting or circling areas of interest on a conductive surface to be analyzed via optical and/or mass spectroscopic methods.

Example 9: Transport Efficiency

A solution (60 μL) of 1 mM rhodamine B in 8:2 methanol: water was sprayed using nanoESI and the ions were collected on the grounded aluminum plate through the use of the elliptical electrode as seen in FIG. 4A. For the deposition experiment the sprayer was 15 mm from the opening plane of the ellipse (17 mm from collection plate) and voltages of 4 and 5.5 kV were applied to the ellipse and sprayer, respectively. For comparison, the same experiment was repeated without the use of the elliptical electrode with a spray potential of 1.5 kV A 1 $cm^2$ area corresponding to the highest deposit concentration for each deposition experiment was re-dissolved in 1:1 methanol:water (v), diluted to a known volume and analyzed for concentration by UV-Vis spectrophotometry. Around 15% of the rhodamine B in the spray solution was deposited in the 1 $cm^2$ collection area in the case of nanoESI (without the elliptical electrode). When the elliptical electrode was employed at the same sprayer to counter electrode distance the entire visible spot was located within the 1 cm2 collection area. Analysis of the concentration showed that this spot corresponded to more than 70% of the theoretical yield. These results show that the elliptical electrode is able to concentrate ions to the deposition area to produce a four-fold increase in ion intensity when compared to nanoESI without the use of a focusing electrode.

Example 10: Comparison of Spot Size and Shape to Simulation Data

Figure 7A:
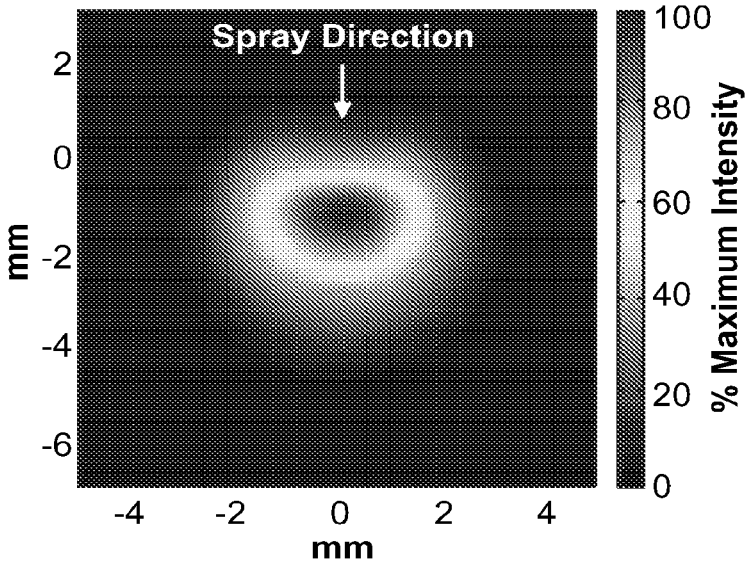
FIGS. 7A-7C show contour plots of simulated ion intensity at the ground plate of the ellipse for sprayer potentials.
Figure 7B:
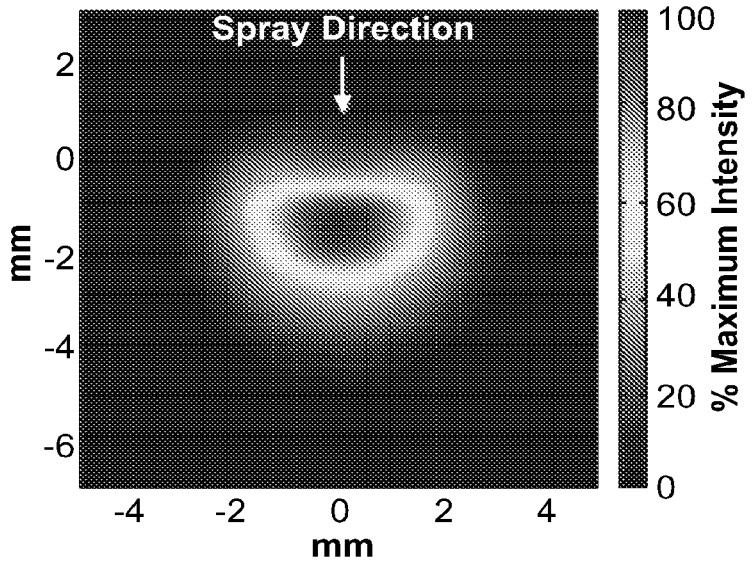
Figure 7C:
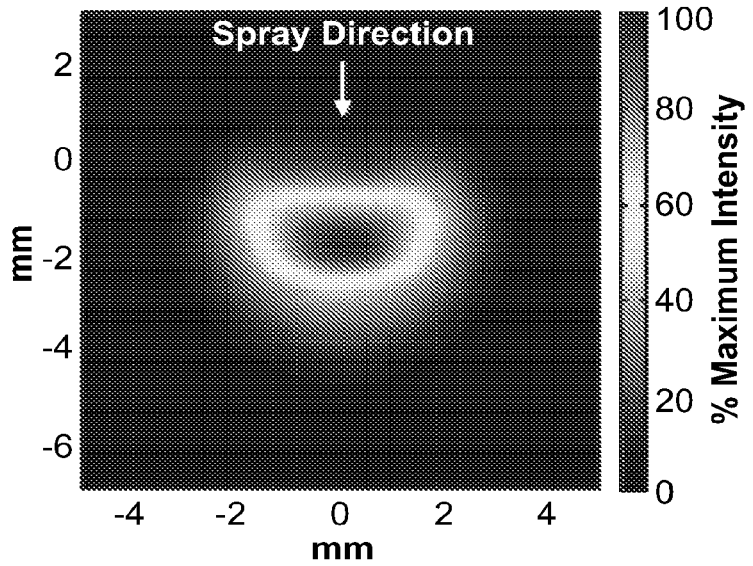

Several simulations were performed using the SDS algorithm to determine the trajectories of ions within the different electrodes and analyze the design effects. The files used to generate the geometry for machining the electrode were converted to potential array (PA) files using the SL Toolkit included with SIMION 8.0. These arrays were refined using the skipped point refining method to solve for the electric field within the electrode. The reduced mobility and diameter of each ion was estimated via the SDS algorithm. A range of different ion mobilities was tested in the simulation, each providing the same resulting intensity plots at the grounded plate. While space charge plays a role in determining the trajectories of ions within the electrode, the methods of incorporating space charge included with SIMION do not effectively model the space charge interaction at ion sources. Because of this, these effects were not included in the simulations of ion motion in the elliptical electrode. Instead, ions were given an initial filled sphere distribution centered at different locations relative to the nanoESI spray tip. This method allowed for a qualitative understanding of trajectories ions undergo in the elliptical electrode to aid in the improvement of electrode designs. Resulting contour plots of simulated ion intensity at the grounded plate are shown in FIG. 7.

Contour plots of ion intensity at a 1 kV potential offset reproduce the shape of the ion intensity (to a limited extent), when compared to the results obtained by the atmospheric pressure ion detection system. As the potential offset is increased, this correlation falls away but does show the experimentally observed result of a broadened ion beam. The phenomenon of charged droplet trajectories from a spray tip is not well modeled with the SIMION-SDS model as the effects of droplet evaporation, droplet breakup, and the differing velocities of droplets ejected from the tip in the range of potentials studied are not considered. The use of the SIMION-SDS algorithm did however, allow for a qualitative study and understanding of ion behavior inside the elliptical electrode.

Example 11: Interfacing with MS

FIGS. 4A-B show the elliptical electrode interfaced with the atmospheric pressure inlet (API) of an ion trap mass spectrometer by the insertion of the API capillary into the hole in the grounded aluminum plate. Through the effects of gas flow, a fraction of the ions impinging on the plate are drawn into the inlet capillary. LTQ calibration mix containing caffeine, MRFA peptide, and Ultramark 1621 was used as the spray solution in all experiments. The dependence of mass spectral intensity on the voltage applied to the different components was tested by scanning the potential of the ellipse from 1 to 6 kV while the sprayer was held at a constant offset of +1 kV in relation to the ellipse potential. The intensities of the protonated caffeine ion (m/z 195), MRFA peptide (m/z 524), and a peak from the Ultramark 1621 (m/z 1322) were recorded as a function of the potential applied to the ellipse (FIG. 8A).

Figure 8A:
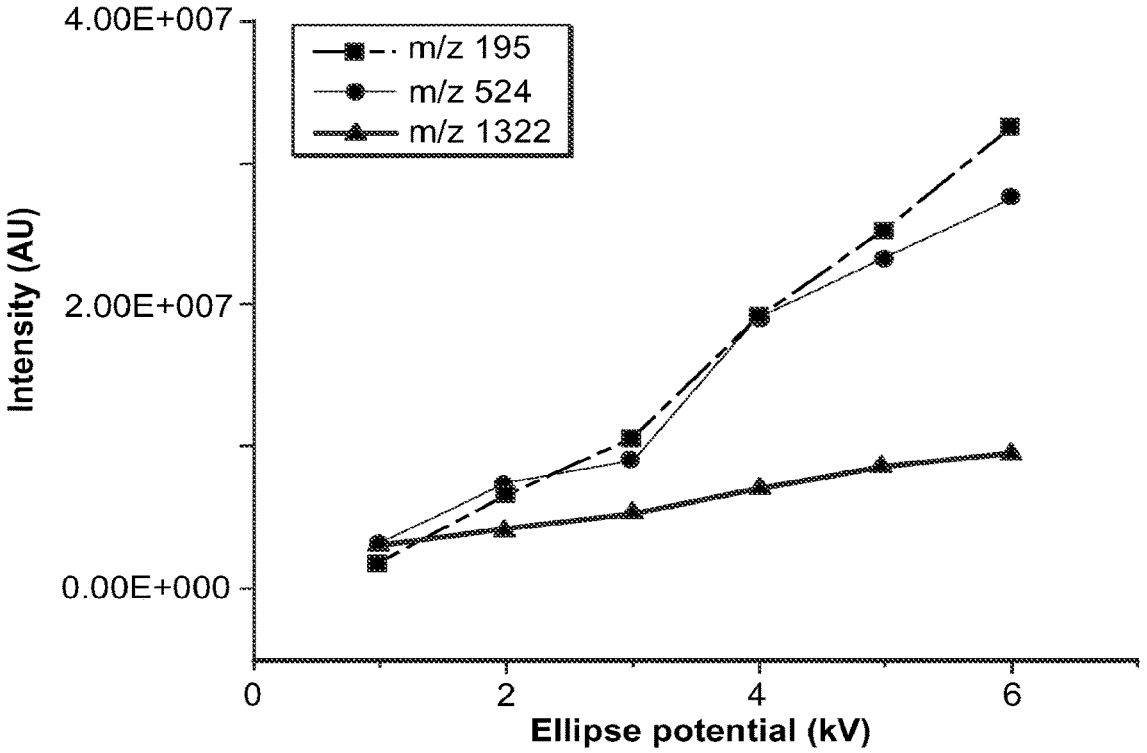
FIGS. 8A-8B show intensities of different ions detected by MS as a function of potential applied to elliptical electrode.

The results shown in FIG. 8A clearly indicate that increasing the potential of the electrode and sprayer results in an increased number of ions delivered to the mass spectrometer. With the larger ion (m/z 1322), the intensity increase is not as dramatic. As larger ions were less mobile than their smaller counterparts, they were transported to the inlet at a slower rate so that less signal was observed. The result is an increased sensitivity for smaller ions when using the elliptical electrode.

Figure 8B:
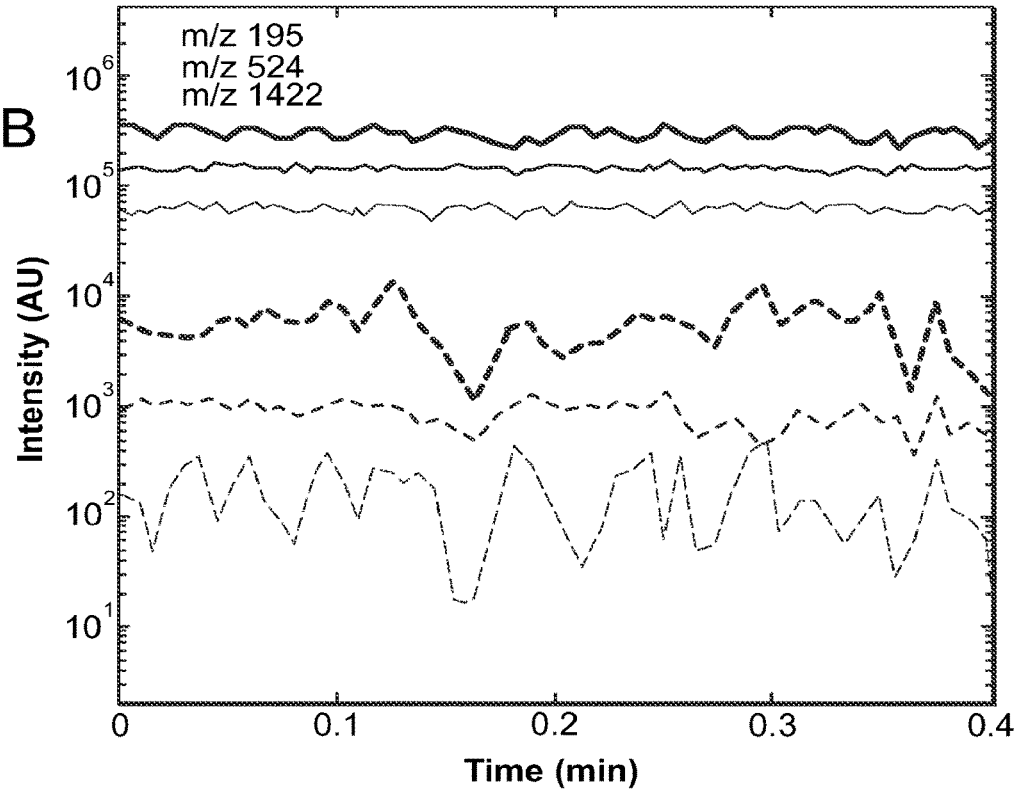
Figure 9A:
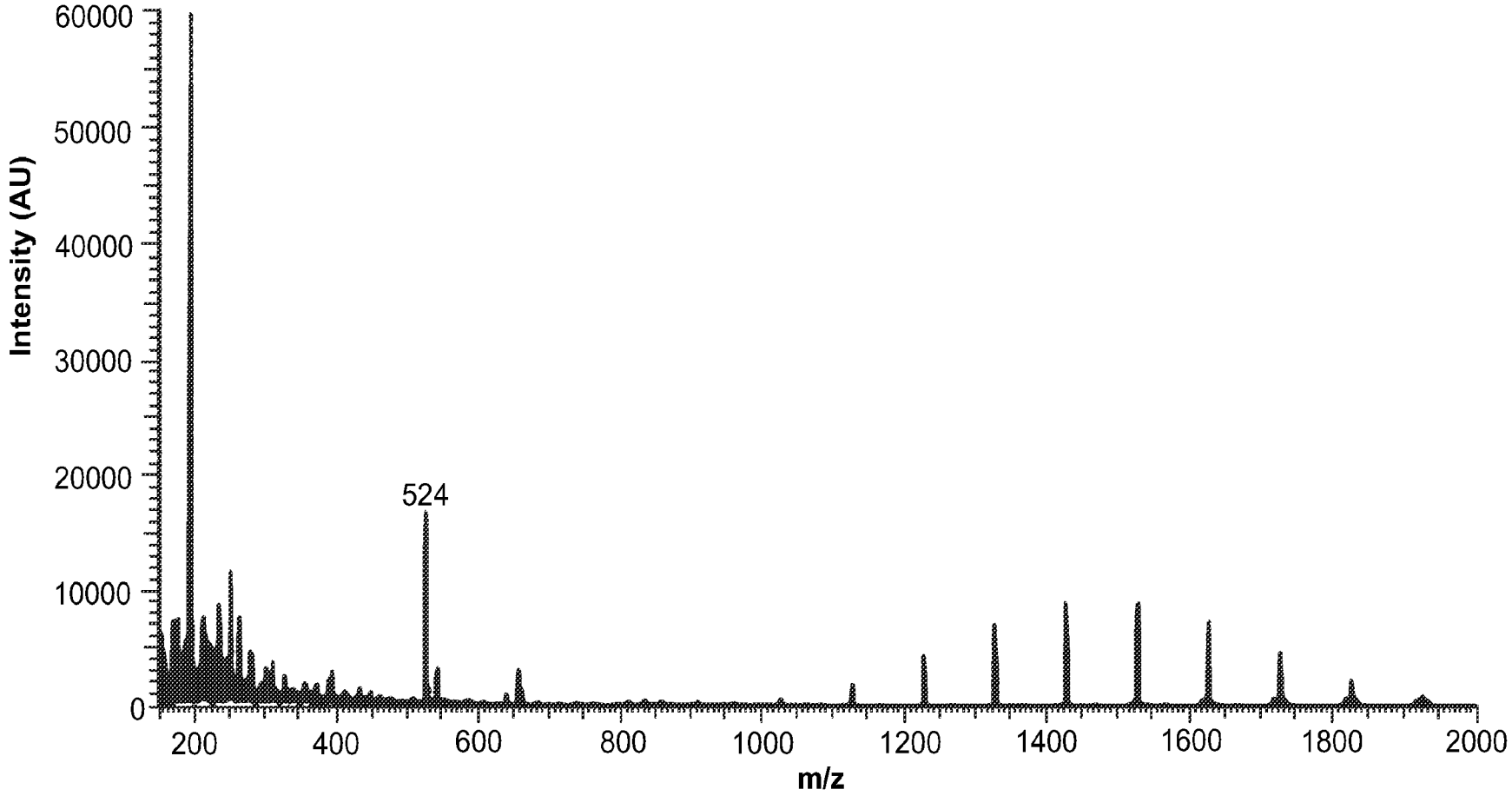
FIG. 9A shows spectra taken of LTQ calibration solution using the elliptical electrode with potentials of 6 and 5 kV applied to the sprayer and ellipse, respectively.
Figure 9B:
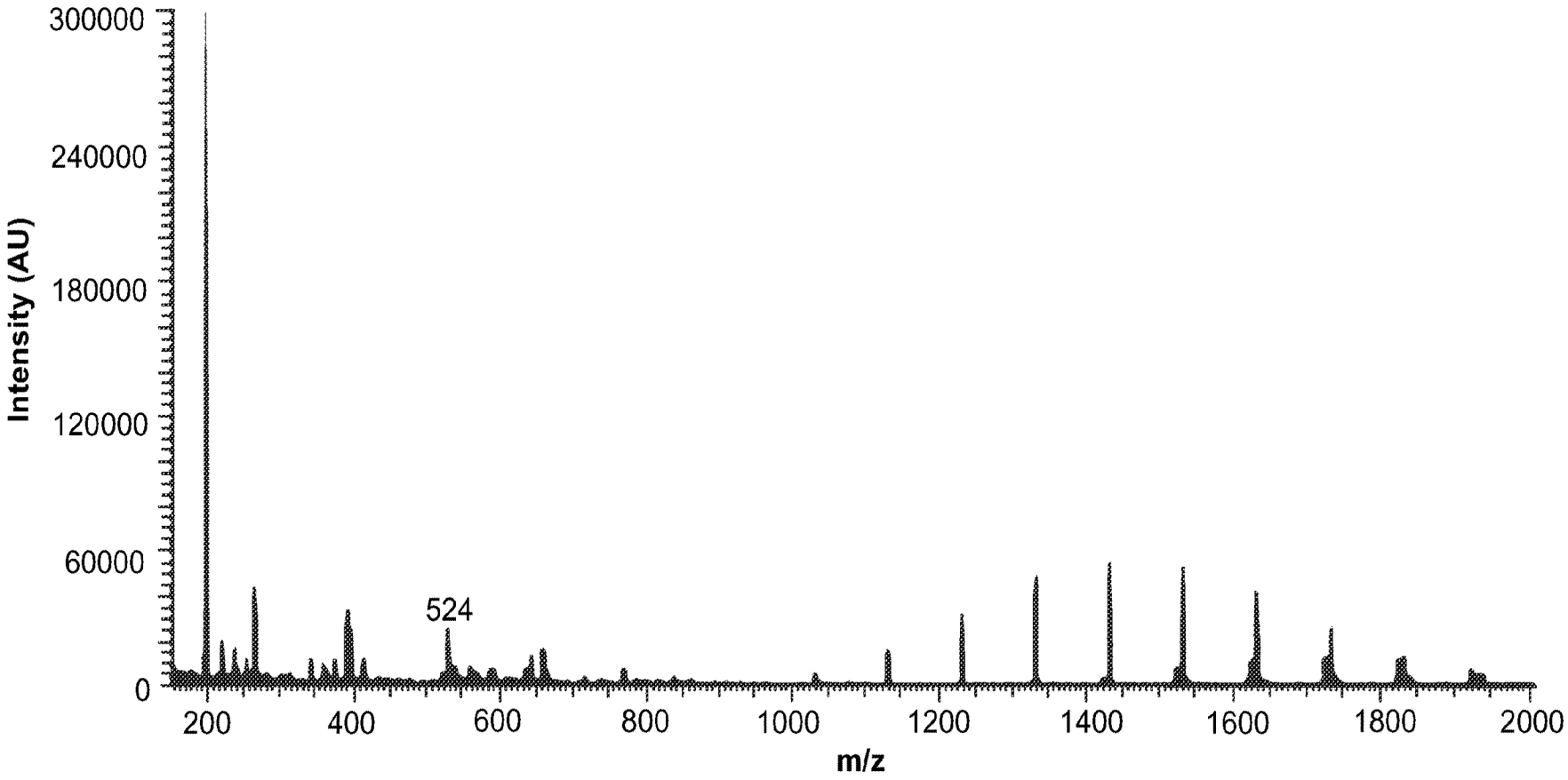
FIG. 9B shows spectra taken of LTQ calibration solution without the use of the focusing electrode at a spray potential of 1 kV. The spray tip to inlet distance was 22 and 3.3 mm in FIGS. 9A-9B, respectively.

The transport of ions from the elliptical lens to the MS was investigated by comparing the ion signal recorded by the MS using the elliptical electrode to the intensities recorded by nanoESI without the electrode but with the same tip to inlet distance. When the elliptical electrode was used potentials of 3 and 4 kV were supplied to the ellipse and sprayer, respectively, while the spray tip was 22 mm from the MS inlet. For the study of intensities without the use of the ellipse, the sprayer was again positioned 22 mm from the inlet and was shielded from air currents that might disrupt the signal intensity. The potential applied to the sprayer in this case was 1 kV to match the offset potential used when the elliptical electrode was employed. FIG. 8B shows the result of these experiments by plotting a chromatogram of several ions characteristic of the calibration solution. The results show up to a 100 fold enhancement of ion signal with the use of the elliptical electrode. It should be noted that intensities higher than those obtained with the elliptical electrode are possible through the use of nanoESI alone. This is accomplished by placing the spray tip in close proximity (2-5 mm) to the inlet; however, this does not always allow for sufficient evaporation of solvent and the spectra obtained are remarkably different in regards to relative ion intensity. Through the use of the elliptical electrode the relative intensity in the MS for the detection of MRFA peptide (m/z 524) was increased by a factor of four over that achieved even at optimum proximity for nanoESI without the focusing electrode (FIG. 9).

In these Examples simple DC-only potentials were applied to an ellipsoidal focusing element to focus organic ions generated by nanoESI in air. Good ion transport efficiency (75%) and signal stability were achieved. The ion focusing depended on the voltage of elliptical electrode, voltage of ion source and the effect of distance between the source and the MS aperture. Signal improvements in optimized operation were observed for focusing from a fixed sprayer to inlet distance. Relative intensity for MRFA peptide increased by a factor of four compared to nanospray experiments in which the emitter was placed very close to the inlet of the mass spectrometer. Simulations of ion motion matched experiments well.

Example 12: Ion Collection

Figure 19:
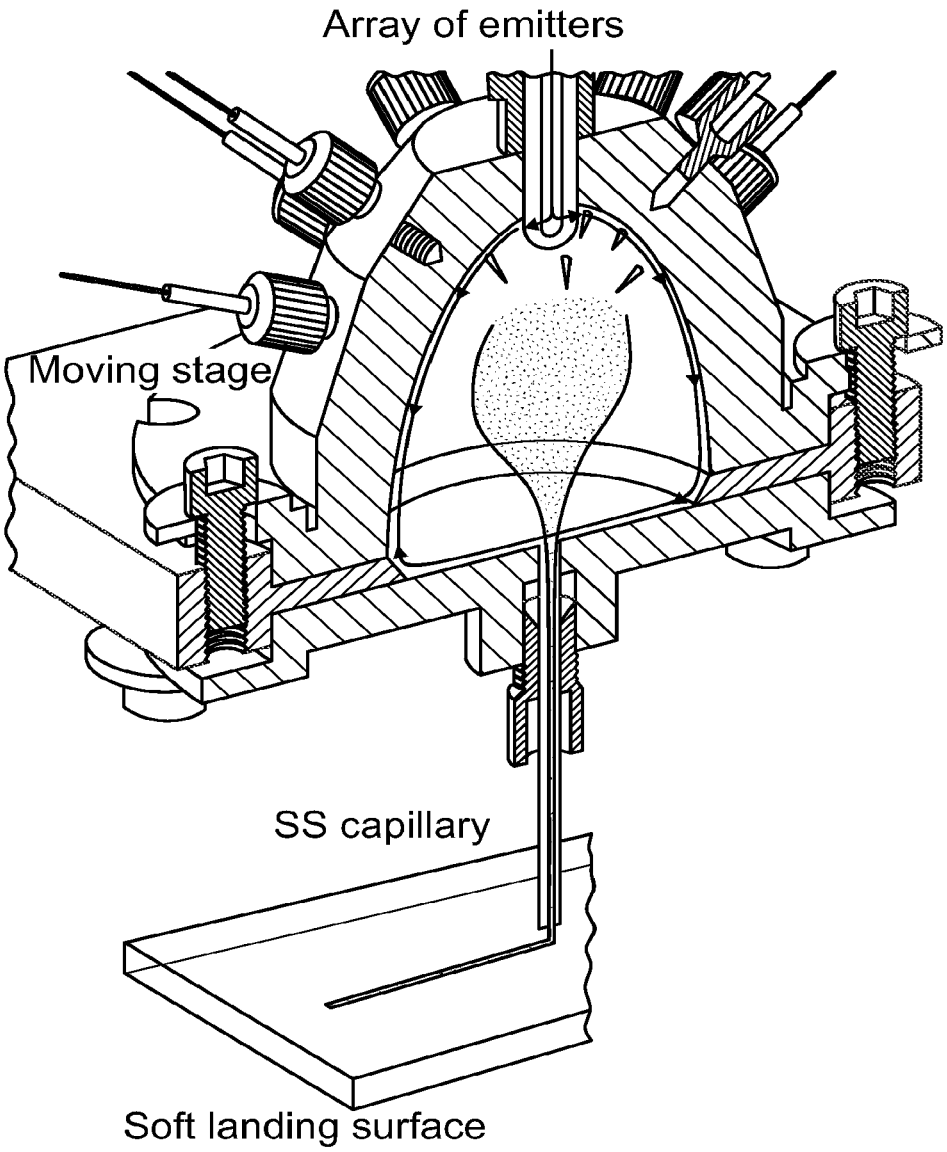
FIG. 19 shows an exemplary embodiment of a system for collecting ions.

FIG. 19 shows an exemplary embodiment of a system for collecting ions. In this embodiment, the focusing apparatus is coupled to a moving stage. The apparatus shown in FIG. 19 includes an array of electrospray emitters, however, different configurations are within the scope of the invention, and the invention does not require more than one electrospray emitter. A high DC field is applied to the focusing electrode, creating an electric field that, optionally with pneumatics, focuses the ions into a steel capillary at the exit of the focusing apparatus. The purple lines and red area represent gas flow and a focused ion cloud. The ions are ejected from a distal end of the capillary and soft landed (collected) on a surface. The moving stage ensures that molecules are being deposited at discreet locations, as shown in FIG. 19.

The soft landed material can have any structure, and in exemplary embodiments, the soft landed ions generate crystalline material. In an exemplary embodiment 1 mM naproxen 2 ug in 4:1 methanol:water was flowed through an electrospray emitter into a focusing device of the invention. Ions were focused and landed on a surface. FIG. 20 shows crystals of naproxen landed on a surface using focusing apparatuses of the invention. In another example, a solution including serine was flowed through an electrospray emitter into a focusing device of the invention. Ions were focused and landed on a surface. FIG. 21 shows serine charged droplets deposited on a surface using focusing devices of the invention. FIG. 21 shows serine crystals growing in the droplets.

Generally, crystal structures produced by soft landing using devices of the invention may be analyzed by any methods known in the art, such as x-ray crystallography. Such analysis is useful when two or more compounds are sprayed into the focusing element, allowed to react, and the reaction product is ejected for the focusing element and soft landed, the reaction product on the surface being a crystal structure. Such product can be analyzed by any method known in the art, for example, x-ray crystallography.

What is claimed is:

1. A method for analyzing a sample, the method comprising:

causing a discharge from a desorption electrospray ionization (DESI) source to impact a sample on a substrate in a manner that the sample is desorbed from the substrate to form droplets of the sample, wherein the cavity is an electrode that is shaped to focus ions;

introducing the droplets of sample into a cavity in the presence of a turbulent gas flow within the cavity to produce sample ions that are focused in the cavity by applying a voltage to the electrode in the presence of the turbulent gas flow;

directing the sample ions that have been focused to an outlet positioned with respect to the cavity to receive the sample ions that have been focused and into an inlet of a mass spectrometer; and analyzing the sample ions.

2. The method according to claim 1, wherein the introducing step comprises introducing the sample ions into an ellipsoidal cavity of the electrode.

3. The method according to claim 1, wherein the focusing step comprises focusing the sample ions at ambient pressure.

4. The method according to claim 1, wherein the method further comprises transferring the sample ions through an ion transfer member prior to the focusing step.

5. The method according to claim 1, wherein the cavity further comprises:

at least one inlet within the electrode configured to operatively couple with the DESI source, such that discharge generated by the DESI source that has reflected from the substrate comprising the sample is injected into the cavity of the electrode; and an outlet;

wherein the cavity in the electrode is shaped such that upon application of voltage to the electrode, ions within the cavity are focused and directed to the outlet, which is positioned such that a proximal end of the outlet receives the focused ions and a distal end of the outlet is open to ambient pressure.

6. The method according to claim 5, wherein the cavity is an ellipsoidal cavity and the introducing step comprises introducing the sample ions into an ellipsoidal cavity of the electrode.

7. The method according to claim 5 wherein the cavity is pressurized and the introducing step comprises introducing the sample ions into the pressurized cavity.

8. The method according to claim 5, wherein the directing step comprises directing the sample ions to an outlet connected to the electrode.

9. The method according to claim 5, wherein the directing step comprises directing the sample ions to an outlet spaced from the electrode.

10. The method according to claim 5, wherein the directing step comprises directing the sample ions to a grounded outlet.

11. The method according to claim 5, further comprising providing gas to the DESI source through a gas inlet.

12. The method according to claim 5, further comprising a plurality of ring electrodes positioned within an interior portion of the cavity such that they are aligned with the outlet, wherein the electrodes are arranged in order of decreasing inner diameter with respect to the outlet, the method further comprising applying a potential to the plurality of ring electrodes.

* * * * *